US011664175B2

(12) United States Patent
Hertzog et al.

(10) Patent No.: US 11,664,175 B2
(45) Date of Patent: May 30, 2023

(54) EXTINGUISHING CHAMBER OF MAGNETIC BLOW-OUT TYPE FOR AN ELECTRICAL BREAKING DEVICE AND ELECTRICAL BREAKING DEVICE EQUIPPED WITH SUCH A CHAMBER

(71) Applicant: SOCOMEC, Benfeld (FR)

(72) Inventors: Jérôme Hertzog, Griesheim Pres Molsheim (FR); Guillaume Oster, Obernai (FR)

(73) Assignee: SOCOMEC, Benfeld (FR)

( * ) Notice: Subject to any disclaimer, the term of this patent is extended or adjusted under 35 U.S.C. 154(b) by 0 days.

(21) Appl. No.: 17/779,875

(22) PCT Filed: Feb. 5, 2021

(86) PCT No.: PCT/EP2021/052772
§ 371 (c)(1),
(2) Date: May 25, 2022

(87) PCT Pub. No.: WO2021/165055
PCT Pub. Date: Aug. 26, 2021

(65) Prior Publication Data

US 2022/0415590 A1 Dec. 29, 2022

(30) Foreign Application Priority Data

Feb. 19, 2020 (FR) ..... 2001629

(51) Int. Cl.
*H01H 33/10* (2006.01)
*H01H 9/44* (2006.01)
(Continued)

(52) U.S. Cl.
CPC ..... *H01H 9/443* (2013.01); *H01H 33/10* (2013.01); *H01H 33/182* (2013.01); *H01H 73/18* (2013.01)

(58) Field of Classification Search
CPC ..... H01H 9/443; H01H 9/44; H01H 73/18; H01H 33/18; H01H 33/182
See application file for complete search history.

(56) References Cited

U.S. PATENT DOCUMENTS 5,475,193 A * 12/1995 Perdoncin ..... H01H 9/46 218/147
6,667,863 B1 * 12/2003 Mallonen ..... H01H 9/36 361/13

(Continued)

FOREIGN PATENT DOCUMENTS

DE 102014015061 A1 4/2015
EP 3242306 A1 11/2017
FR 3003101 A1 9/2014

*Primary Examiner* — Truc T Nguyen
(74) *Attorney, Agent, or Firm* — Forge IP, PLLC

(57) ABSTRACT

An extinguishing chamber of magnetic blow-out type for a breaking device includes a field source, a magnetic carcass and a breaking region, in which an electric arc is liable to form when a breaking pole belonging to the breaking device is opened. The field source is arranged to generate a magnetic field intended to move the electric arc in order to stretch it and accelerate its cooling and its extinguishing. The carcass is arranged to channel the magnetic field. The carcass is stood up against the field source and closes in front thereof so as to create an air gap in the magnetic circuit formed by the field source and the carcass and to thus maximize the magnetic field that passes through the breaking region.

23 Claims, 16 Drawing Sheets

(51) Int. Cl.
*H01H 33/18* (2006.01)
*H01H 73/18* (2006.01)

(56) References Cited

U.S. PATENT DOCUMENTS

| | | | | |
|---|---|---|---|---|
| 9,679,720 | B1 | 6/2017 | Bugryn | |
| 9,704,676 | B1 * | 7/2017 | Cardwell | H01H 9/362 |
| 9,979,244 | B2 | 5/2018 | Droit et al. | |
| 10,211,003 | B1 | 2/2019 | Fasano | |
| 10,957,504 | B1 * | 3/2021 | Shea | H01H 9/36 |
| 2005/0030136 | A1 * | 2/2005 | Babich | H01F 7/1607 335/220 |
| 2013/0284702 | A1 | 10/2013 | Hamada et al. | |
| 2015/0114934 | A1 * | 4/2015 | Juds | H01H 33/08 218/149 |
| 2017/0025232 | A1 | 1/2017 | Hiraki et al. | |

* cited by examiner

EXTINGUISHING CHAMBER OF MAGNETIC BLOW-OUT TYPE FOR AN ELECTRICAL BREAKING DEVICE AND ELECTRICAL BREAKING DEVICE EQUIPPED WITH SUCH A CHAMBER

TECHNICAL FIELD

The present invention relates to an extinguishing chamber of magnetic blow-out type for an electrical breaking device, said chamber comprising a magnetic field source, a magnetic carcass and a breaking region in which an electric arc is liable to form when a breaking pole belonging to a breaking device is closed and/or opened, said field source being arranged to generate a magnetic field intended to move said electric arc in order to stretch it and accelerate its cooling and its extinguishing, said magnetic carcass being arranged to channel said magnetic field, said breaking pole comprising a fixed contact and a movable contact which moves with respect to said fixed contact between a closed position and an open position on a path defining a breaking plane, and said breaking region extending at least in said breaking plane.

The present invention also relates to an electrical breaking device equipped with such an extinguishing chamber of magnetic blow-out type.

PRIOR ART

The magnetic blow-out of the electric arc is a principle commonly used in the breaking technologies in order to manage the electric arc which arises in particular when a breaking unit is opened in an electric circuit, for the purpose of achieving a gain in breaking performance and preserving the integrity of the breaking unit. The magnetic field, which can be generated by any type of magnetic field source, makes it possible to move the electric arc as soon as it arises and to stretch it rapidly in order to accelerate its cooling until it is extinguished. The cooling of the plasma of the electric arc has the effect of increasing its impedance, which makes it possible to increase the voltage of the electrical arc during the breaking. The breaking of direct current (DC) implies that the breaking unit generates more voltage than the voltage of the network to be broken. This is the reason why the principle of magnetic blow-out applies particularly well to the breaking of DC current. Nevertheless, a high voltage of the electric arc is also advantageous for the breaking of alternating current (AC), since it allows a limitation of the current when it is broken, which has the effect of reducing damage due to the arc or even of reducing the duration of the electric arc by a limiting effect. Consequently, this principle of magnetic blow-out of the arc is just as advantageous for DC current as for AC current.

The publication FR 3 003 101 A1 of the applicant proposes a principle of non-polarized magnetic blow-out, which has the advantage of working independently of the direction of the current in the breaking unit. The extinguishing chamber comprises a permanent magnet producing a magnetic field oriented in the plane of movement of the movable contacts with respect to the fixed contacts. The symmetry of the extinguishing chamber with respect to this plane makes it possible to guarantee the non-polarization of this breaking principle. In this publication, principles of channeling the magnetic field have already been proposed in the form of a planar ferromagnetic plate located to the rear of the permanent magnet or of a U-shaped ferromagnetic plate which encompasses the rear and the two sides of the magnet. The fact of channeling the magnetic field in the breaking region makes it possible to reduce the size of the permanent magnet. However, the field channeling obtained is not optimal.

The publication EP 3 242 306 A1 attempts to remedy this lack by proposing another magnetic blow-out principle, in which the permanent magnet is polarized and its North and South poles are coupled to two ferromagnetic plates, respectively, which extend parallel on both sides of the breaking region and in the direction of an arc extinguishing chamber. This solution requires polarizing the magnet depending on the direction of the current in the breaking unit. Moreover, the length of the air gap is large, since it depends on the space requirement of the breaking unit and the length of the magnet. In fact, the channeling of the magnetic field is not implemented optimally, since the air gap generates a high magnetic reluctance in the magnetic circuit, which is detrimental to the blow-out efficiency, which can explain the presence of the arc extinguishing chamber. Indeed, a magnetic circuit excited by a magnet which has a large air gap will not generate a high magnetic field value. Now, it is indeed the value of this field which generates the force of movement on the electric arc, referred to as Laplace force ($F=I\hat{}B$).

In the publication US 2017/025232, the magnetic extinguishing chamber is insulating, it surrounds one or two fixed contacts, and it comprises a window for the passage of the movable contact or of the two movable contacts. Moreover, it comprises an insulating central partition in order to create an annular channel promoting the circulation of the air in one direction or in the other direction, which has the effect of preventing the rise of the air pressure due to the temperature of the arc, which prevents the magnetic stretching of the arc and its rapid extinguishing. One of the embodiment variants comprises a U-shaped magnetic carcass, arranged around the extinguishing chamber and a polarized blow-out magnet, for the purpose of maximizing the magnetic field in the breaking regions. Nevertheless, the length of the air gap is large due to the presence of the central partition and the annular channel for circulation of the air. In fact, the air gap generates a high magnetic reluctance in the magnetic circuit which is detrimental to the efficiency of the blow-out.

The publications US 2013/284702 and DE 10 2014 015061 propose U-shaped or V-shaped arc extinguishing chambers consisting of splitting sheets made of magnetic material and combined with two insulated polarized permanent magnets arranged facing one another, on both sides of the breaking region, inside or outside of the extinguishing chamber. In the publication DE 10 2014 015061, a U-shaped magnetic carcass is moreover arranged around the extinguishing chamber and the polarized blow-out magnets. Again, the air gap is large and generates a high magnetic reluctance in the magnetic circuit, which is detrimental to the efficiency of the blow-out.

Furthermore, the magnetic field which generates the magnetic blow-out is often implemented with permanent magnets of the Neodymium Iron Boron type. These magnets have the advantage of generating a strong magnetic field in their near vicinity, typically of approximately 0.2 T. However, they are expensive and subject to variations of the cost of the rare earths of which they are made.

Consequently, there is a need for extinguishing chambers of magnetic blow-out type which have a performance equivalent to or greater than the extinguishing chambers of the prior art, making it possible to use either a smaller quantity of high-grade magnet of the Neodymium Iron Boron type, or lower-grade, but also cheaper magnets such as, for example, magnets of ferrite type or similar magnets.

PRESENTATION OF THE INVENTION

The present invention aims to meet this demand by proposing a novel architecture of an extinguishing chamber of magnetic blow-out type making it possible to maximize the magnetic field, thus the magnetic blow-out of the electric arc in the breaking region, in order to increase the breaking performances, while making it possible to play on the cost, the volume and/or the nature of the field source used.

For this purpose, the invention relates to an extinguishing chamber of magnetic blow-out type indicated in the preamble, characterized in that said extinguishing chamber has a mostly symmetrical form with respect to a median plane which coincides with said breaking plane, in that said field source is arranged in the near vicinity of and opposite said breaking region, and is oriented in order to generate magnetic field vectors which are essentially parallel to said breaking plane, in that said carcass surrounds said breaking region and said field source and comprises a window which is open toward the outside to allow the passage of said movable contact, and in that said carcass is stood up against said field source and closes in front thereof so as to create an air gap in the magnetic circuit formed by said field source and said carcass and to thus maximize the magnetic field which passes through said breaking region.

Preferably, the smallest possible air gap is selected, since, for the same field source, the smaller the air gap, the more the magnetic reluctance in the air is reduced and the greater the magnetic excitation.

Depending on the embodiment variants, said carcass can comprise an open peripheral wall delimiting said window which extends parallel to said breaking region, or a closed peripheral wall and an opening at at least one of the transverse ends of said peripheral wall delimiting said window, which in this case extends perpendicular to said breaking region.

Said extinguishing chamber can also extend over a length greater than the length of said breaking region in said breaking plane. In this case, said carcass advantageously comprises a partially open and partially closed peripheral wall, the open portion delimiting said window which extends parallel to said breaking region, and the closed portion extending said open portion and delimiting a blow-out chimney for the extension of the electric arc.

Said carcass moreover can comprise at least one transverse wall closing at least one of the transverse ends of said peripheral wall.

The peripheral wall of said carcass can have a transverse section having a form selected from the group comprising a curved form, a polygonal form, a complex form, a form combining straight sections and curved sections, and, in the case of a polygonal form, it can be selected from the group including a rectangle, an isosceles trapezoid, a C-shaped form, the ends of which form flaps oriented toward the outside or toward the inside of said breaking region, or parallel to said breaking region.

Depending on the needs, said field source can be selected from the group including one or more permanent magnets, and one or more coils. Preferably, said field source extends over a surface substantially equal to the surface of said extinguishing chamber.

In a preferred embodiment of the invention, the extinguishing chamber of magnetic blow-out type comprises an internal insulating envelope extending at least partially around said breaking region in order to electrically insulate said field source and at least partially said carcass. It can also comprise an external insulating envelope extending around said carcass.

Advantageously, said carcass extends over a transverse dimension, perpendicular to the breaking plane, in order to divide said breaking region into a region of appearance in which the electric arc arises and at least one region of extinguishing in which the electric arc is stretched and extinguished. This transverse dimension can be equal to at least X times the transverse dimension of said region of appearance, X being between 2 and 10.

Preferably, the geometry of said extinguishing chamber delimits a narrow and flattened breaking region in order to force the electric arc to flatten when it is moved by said magnetic field. Thus, said air gap, created in the magnetic circuit formed by said field source and said carcass, is narrow in order to reduce the magnetic reluctance in the air and maximize the magnetic field which passes through said breaking region.

Depending on the embodiment variants, said carcass can consist of one solid ferromagnetic part in order to channel the magnetic field, or of a stack of ferromagnetic splitting sheets, extending in the longitudinal axis of said extinguishing chamber, with a defined spacing, in order to simultaneously channel the magnetic field and split the electric arc, or can consist of a combination of a solid part and a stack of splitting sheets.

Said carcass moreover can comprise a ramp arranged to narrow the thickness of the breaking region in the direction of the end of said at least one region of extinguishing in order to further reduce said air gap.

Additionally, said extinguishing chamber of magnetic blow-out type can comprise ceramic insulating end plates, superposed at least partially on said internal insulating envelope, on both sides of said breaking region.

For this purpose, the invention also relates to an electrical breaking device of the type indicated in the preamble, characterized in that it comprises an extinguishing chamber of magnetic blow-out type as defined above.

In one of the embodiment variants, said fixed contact can have the form of a bracket having an inner branch which extends inside of said extinguishing chamber in said median plane, and an outer branch extending outside of said extinguishing chamber in order to form a connection terminal. The inner branch of said fixed contact can advantageously comprise a summit positioned in a central portion of said breaking region, thus placing the region of appearance of the electric arc in a central portion of said extinguishing chamber.

The inner branch of said fixed contact can moreover comprise a broadened base delimiting at least one heel oriented toward an end of said extinguishing chamber in one of the regions of extinguishing of the electric arc. In this case, the splitting sheet of said extinguishing chamber closest to said fixed contact can advantageously be connected to the potential of said fixed contact by said at least one heel.

In a preferred embodiment of the invention, the splitting sheet of said extinguishing chamber farthest from said fixed contact can be connected to the potential of said movable contact by an electrical conductor.

If the breaking device comprises two extinguishing chambers per breaking pole, then the carcasses of said extinguishing chambers can be coupled to one another by a common sheet replacing or added to the splitting sheets farthest from said fixed contact, with it being possible for this common sheet to be connected or not connected to the potential of said movable contact by an electrical conductor.

BRIEF DESCRIPTION OF THE FIGURES

The present invention and its advantages will become clearer in the following description of multiple embodiments given as non-limiting examples in reference to the attached drawings in which.

DETAILED DESCRIPTION OF THE INVENTION

In the different illustrated embodiment examples, identical elements or portions bear the same reference numbers. Moreover, the geometric positions indicated in the description and the claims, such as "perpendicular", "parallel", "symmetrical" are not limited to the strict meaning defined in geometry but extend to geometric positions which are similar, that is to say which accept a certain tolerance in the technical field in question, without influence on the result obtained. This tolerance is notably introduced by the adverb "substantially," without this term necessarily being repeated before each adjective. Likewise, the spatial indications indicated in the description and the claims, such as "longitudinal", "transverse", "depth", "upper", "lower", etc., are based on the figures and are not limited to the examples illustrated.

Figure 18:
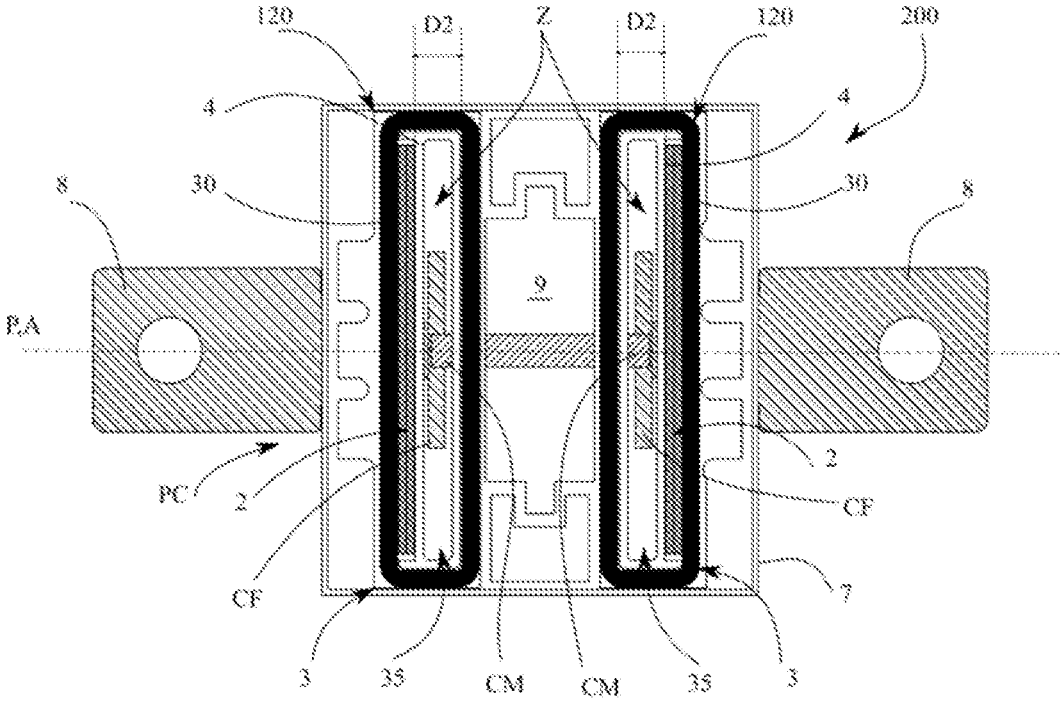
FIG. 18 is a transverse sectional view of an electrical breaking device equipped with two extinguishing chambers according to FIGS. 13 and 14.

In reference to the figures, the extinguishing chamber of magnetic blow-out type according to the invention, referred to below as "extinguishing chamber 100, 110, 120, 130, 140", is intended to equip electrical breaking devices 200, 300 which relate to all types of industrial, tertiary and domestic applications, supplied with direct current as well as with alternating current, and this regardless of the nominal supply voltage. This extinguishing chamber 100, 110, 120, 130, 140 can advantageously replace or supplement the traditionally known splitting chambers depending on the desired breaking performances. The electrical breaking devices 200, 300 in question can equally well be a switch, a contactor, a changeover switch, a changeover switch-inverter, a disconnecting switch, or any other similar breaking device, given that the extinguishing chamber 100, 110, 120, 130, 140 which is the subject matter of the present invention, can be compatible with or adapted to any type of architectures of breaking devices. Likewise, these electrical breaking devices 200, 300 can comprise one or more breaking poles PC, and each breaking pole PC can be a single breaking pole with a single fixed contact CF cooperating with a single movable contact CM, or a double breaking pole with two fixed contacts CF cooperating with a movable contact CM as represented in FIGS. 18, 21 and 27. In all the cases, the movable contacts CM are arranged to be moved with respect to the fixed contacts CF and the path in which the movable contacts CM move defines a breaking plane P, whether this movement is a translation (represented by arrow T) or a rotation (not represented). Moreover, there are multiple types of architecture of breaking poles PC, depending on whether they comprise contacts of pressure type according to FIGS. 1 to 3, 13 to 16, 18, and 22 to 28, sliding contacts according to FIGS. 19 to 21, contacts of pressure type with cam control, or any other type of electrical contacts.

The extinguishing chamber 100 according to a first embodiment of the invention illustrated in FIGS. 1 to 6 is substantially rectangular and arranged to delimit a breaking region Z in which an electric arc E is liable to form, in particular when a breaking pole PC belonging to an electrical breaking device is opened, and to be extinguished as rapidly as possible. For this purpose, it comprises a field source 2 arranged to generate a magnetic field B intended to move said electric arc E in order to stretch it and accelerate its cooling and its extinguishing, a magnetic carcass 3 arranged to channel the magnetic field B in general and more particularly in the breaking region Z, and an internal insulating envelope 4 arranged to electrically insulate the breaking region Z and consequently the electric arc E from the field source 2 and from the carcass 3. This internal insulating envelope 4 can be implemented by any electrically insulating material, also including a gas generating material, which also has the effect of absorbing the thermal energy of the electric arc E, promoting its cooling and consequently its extinguishing.

The breaking pole PC is represented in the figures by a fixed contact CF arranged inside of the extinguishing chamber 100 and a movable contact CM arranged partially inside of the extinguishing chamber 100 opposite the fixed contact CF and partially outside of the extinguishing chamber in order to be controlled by an actuation mechanism 201, 301 (FIG. 18, 21). This arrangement example is not limiting and extends to any other type of arrangement which depends on the architecture of the breaking pole PC. Notably, the fixed contact CF is not necessarily accommodated inside of the extinguishing chamber but it can be accommodated partially there, or arranged nearby. Moreover, the actuation mechanism in itself is known and the invention does not relate to it. It can be given a translation movement and/or rotation movement controlled manually and/or automatically. And the breaking region Z extends at least in the breaking plane P and corresponds at least to the space defined between the open position and the closed position of the breaking pole PC. The fixed contact CF and the movable contact CM commonly comprise contact pads (not represented) between which the current forms, and implemented using conductor materials with high thermal resistance.

In the examples represented, the extinguishing chamber 100, 110, 120, 130, 140 has a mostly symmetrical form with respect to a median plane A which coincides with the breaking plane P. This symmetry makes it possible to advantageously be independent of the polarity of the field source 2 which will always perform its function regardless of the direction of the current in the breaking pole PC. Nevertheless, it can also have an asymmetrical form depending on the architecture of the breaking pole PC, without however calling into question the fact that it can be independent of the polarity of this field source 2.

Moreover, the extinguishing chamber 100, 110, 120, 130, 140 extends over a longitudinal dimension, parallel to the median plane A, which extends at least between the closed position (FIG. 1) and the open position (FIG. 2) of the movable contact CM of said breaking pole PC. And the extinguishing chamber 100, 110, 120, 130, 140 extends over a transverse dimension L2, perpendicular to the median plane A, which extends beyond on one side or on both sides of the breaking pole PC. Thus, the breaking region Z, which corresponds to the interior volume delimited by the extinguishing chamber 100, 110, 120, 130, 140, is divided into at least one region of appearance Za in which the electric arc E arises and a region of extinguishing Ze in which the electric arc E is extinguished (Z=Za+Ze(s)). The region of appearance Za is located at the breaking pole PC and overlaps the breaking plane P. The region(s) of extinguishing Ze is/are adjoining and peripheral to the region of appearance Za. The transverse dimension L2 is, for example, at least equal to X times the transverse dimension L1 of the region of appearance Za, X being between 2 and 10, without this coefficient being limiting. If the extinguishing chamber is asymmetric, it can comprise only one region of extinguishing Ze on one side of the region of appearance Za. As an option, the region(s) of extinguishing Ze can moreover comprise fins (not represented) made of a non-magnetic material, such as a non-magnetic material made of copper, ceramic, plastic materials or the like, in order to create baffles and split the electric arc E for the purpose of accelerating its extinguishing.

Figure 17:
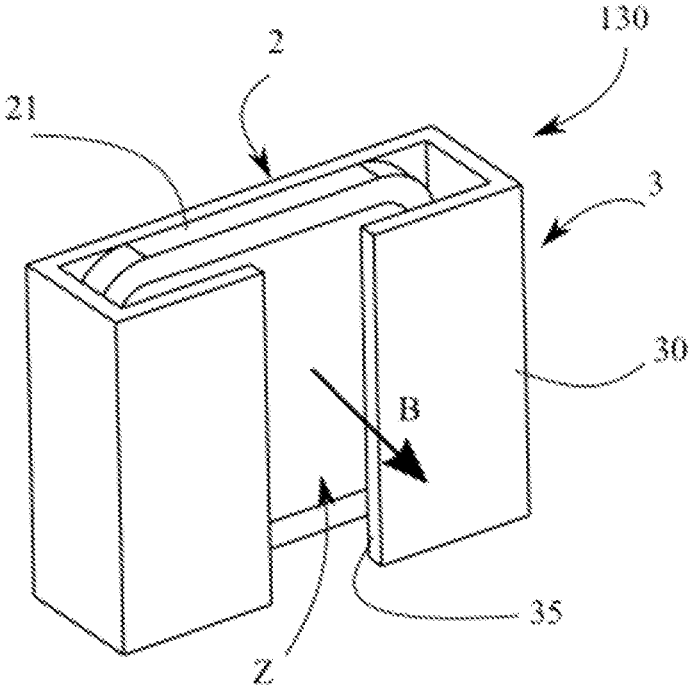
FIG. 17 is a perspective view of an extinguishing chamber according to a fourth embodiment of the invention, in which the magnetic field source consists of an electrically supplied coil instead of a permanent magnet.

The field source 2 is arranged in the near vicinity and opposite the breaking region Z. The field source 2 has a large surface since it substantially covers the entire surface of the extinguishing chamber 100, 110, 120, 130, 140. It extends over a longitudinal dimension, along an axis parallel to the median plane A, and preferably covers the entire breaking region Z. And it extends over a transverse dimension, along an axis perpendicular to the median plane A and also preferably covers the entire breaking region Z. Moreover, it is oriented perpendicular to the breaking plane P, in order to generate a magnetic field B in the direction of the breaking region Z, in such a manner that the magnetic field vectors are essentially parallel to the breaking plane P. It can consist of one or more permanent magnets 20, or any other equivalent system capable of generating a magnetic excitation, such as an electrically supplied coil 21 (FIG. 17). In the examples represented, the field source 2 has a planar, parallelepiped form, without this form being limiting. In fact, it is possible to implement a field source 2 the form of which is adapted to the architecture of the breaking pole PC, which can be curved in the case, for example, of a rotating breaking device. In this case, it can consist of a plurality of parallelepiped permanent magnets 20 arranged side by side on a curved line, or of a permanent magnet 20 molded in a curved form. In this case, the form of the carcass 3 is adapted to the form of the field source 2.

According to FIGS. 1 to 6, the permanent magnet 20 is an independent North-South magnet, defined by two faces with opposite polarities and parallel to one another, generating a magnetic field B which closes onto itself. Preferably, the face which corresponds to the North pole N, referred to as the front face, is positioned opposite the breaking region Z in order to create a magnetic field B or a magnetic excitation vector which leaves its North pole N and closes onto its South pole S, corresponding to its opposite face, referred to as rear face, via the carcass 3. This magnetic field B is concentrated in the breaking region Z. Its field lines describe loops that are essentially parallel to a transverse plane corresponding to the section plane of FIGS. 4 to 6. The field lines moreover are essentially parallel to the breaking plane P in said breaking region Z and in fact are essentially perpendicular to the current I circulating between the fixed contact CF and the movable contact CM of the breaking pole PC. The magnetic blow-out principle is explained further below in reference to FIGS. 3 to 5.

The magnetic carcass 3 has a rectangular form, in reference to FIGS. 1 to 6, it being specified that in fact rounded angles will be preferred over right angles in order to facilitate the circulation of the magnetic field B. The carcass 3 is made of a ferromagnetic or magnetic material, or any other equivalent material with high magnetic permeability allowing it to perform its function of channeling the magnetic field B. It consists of a solid part which can be made from a single sheet, formed by folding and/or by bending and/or by extrusion around said median axis A, or of multiple sheet sections, assembled by simple juxtaposition (by contact) and/or by welding or by any other manufacturing and assembly method, around said median axis A, with it possible for the sheet or the sheet sections to be made of one or more adjoining superposed sheets of material. In all the examples represented, the carcass 3 surrounds the breaking region Z and the field source 2 as close as possible, and comprises at least one window 35 open toward the outside to allow the passage of the movable contact CM of the breaking pole PC.

In the example of FIGS. 1 to 6, the carcass 3 comprises a peripheral wall 30 which is closed at one of its ends by a transverse wall 31 and open at its other end notably allowing the removal of the gases originating from the electric arc E. It would be possible for it not to comprise a transverse wall 31 and for it to be open on both sides, or, on the other hand, it could comprise two transverse walls closing its two ends in order to optimize the confinement of the electric arc E, and this depending on the production specifications of each extinguishing chamber. The peripheral wall 30 of the carcass 3 comprises a rear face 32, two lateral faces 33, and a front face 34 comprising said window 35. In this variant, the window 35 extends over the entire longitudinal dimension of the extinguishing chamber 100, centered about the median axis A. The rear face 32 of the carcass 3 is preferably parallel to and adjoins the rear face of the field source 2 in order not to create an air gap. Moreover, it has a length which is greater than the length of the field source 2 in order to prevent the ends of the field source 2 from coming in contact with the lateral faces 33 of the carcass 3 and thus to prevent any risk of magnetic short circuit with the field source 2. The front face 34 of the carcass 3 closes on the front face of the field source 2 forming an air gap D2 in the magnetic circuit formed by said field source 2 and said carcass 3. In this example, the front face 34 comprises two flaps 34*a*, 34*b* which extend parallel to the rear face 32 of the carcass 3, and it delimits with the front face of the field source 2 a volume of air in which the breaking region Z is located. This volume of air, which forms said air gap D2, is passed through by the field lines B which leave the North pole N of the field source 2, pass through the breaking region Z and loop back toward the South pole S of the field source 2 while being channeled by the flaps 34*a*, 34*b* of the front face 34, the lateral faces 33 and the rear face 32 of the carcass 3. Consequently, an air gap D2 having the smallest possible length will be selected in order to reduce to the minimum the magnetic reluctance of the thickness of air through which the field lines pass and to thus maximize the magnetic field B in the breaking region Z. The length of the air gap D2 can be determined depending on the volume of the breaking region Z which itself depends in part on the space requirement of the breaking pole PC.

Figure 1:
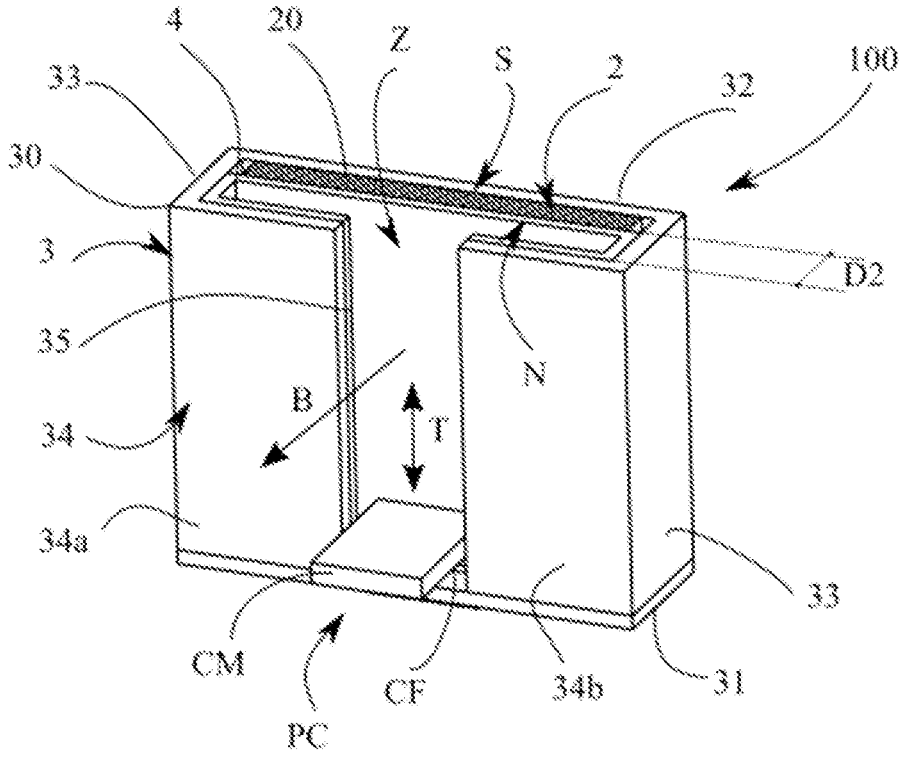
FIG. 1 is a perspective view of an extinguishing chamber according to a first embodiment of the invention, combined with a breaking unit of pressure type in closed position.
Figure 2:
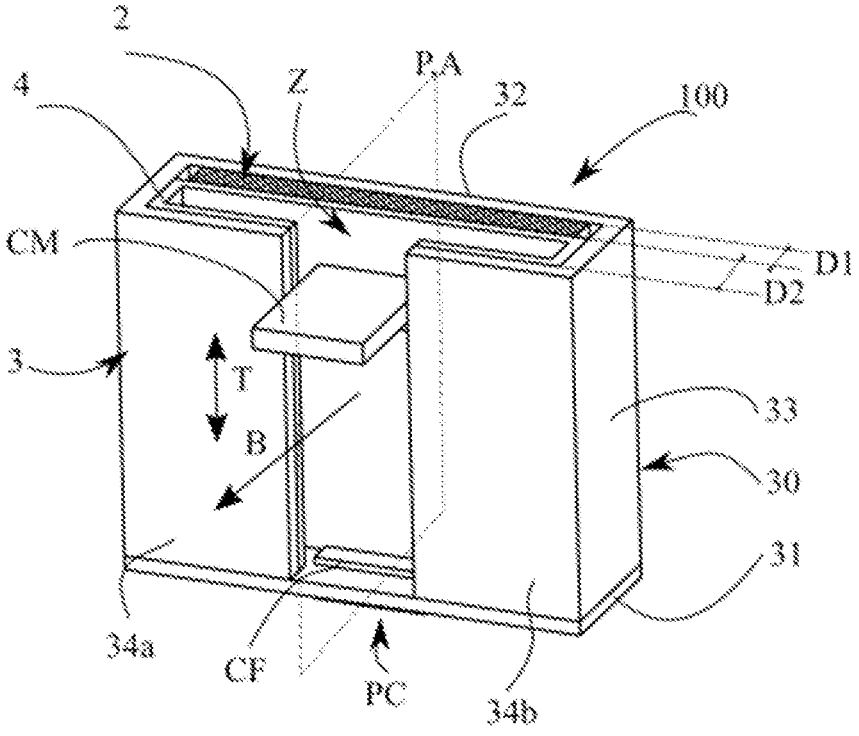
FIG. 2 is a view similar to FIG. 1, showing the breaking unit in open position.
Figure 3:
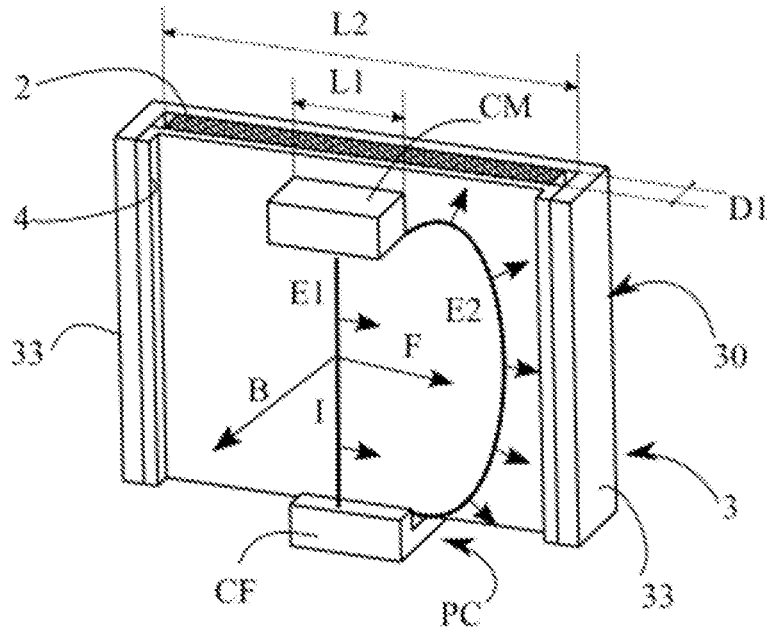
FIG. 3 is a longitudinal sectional view of the extinguishing chamber of FIG. 2, showing the magnetic blow-out of the electric arc.

The extinguishing chamber 100 represented in FIG. 1 corresponds to a closed position of the breaking pole PC, in which the movable contact CM is closed onto the fixed contact CF allowing the circulation of a current I in an electric circuit. FIG. 2 corresponds to an open position of the breaking pole PC, in which the movable contact CM is separated from the fixed contact CF prohibiting the circulation of said current I. When the electric circuit is opened, an electric arc E forms between the fixed contact CF and the movable contact CM, maintaining the circulation of the current I. FIG. 3, which is a longitudinal sectional view of the extinguishing chamber 100, makes it possible to visualize the position of the electric arc E at the time of its appearance (E1), in which it extends substantially vertically between the fixed contact CF and the movable contact CM in the breaking plane PC and in said region of appearance Za, and then its position after magnetic blow-out (E2) in which it is deformed and stretched in the direction of one of the lateral faces 33 of the carcass 3 outside of the breaking plane PC and in one of said regions of extinguishing Ze. The electromagnetic forces F involved for this magnetic blow-out are represented by the vectors F.

Figure 4:
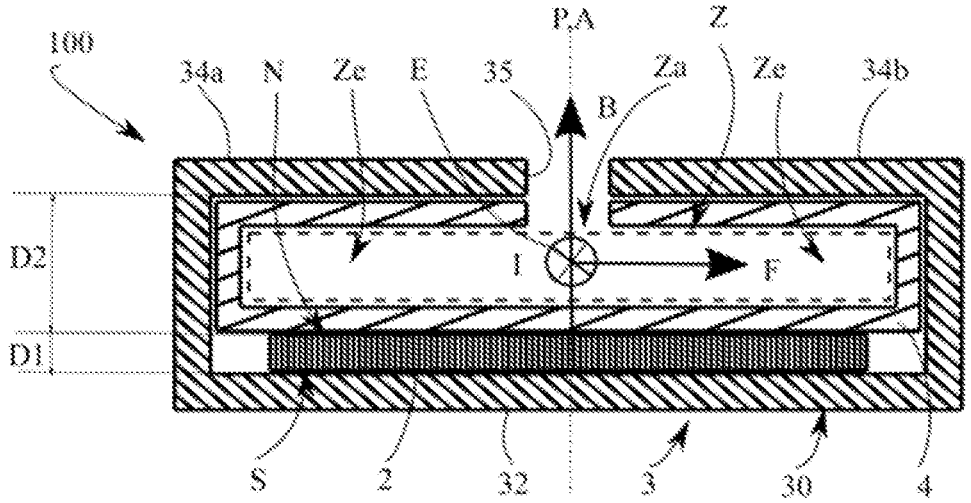
FIG. 4 is a transverse sectional view of the extinguishing chamber of FIG. 2, representing the electromagnetic force exerted by a magnetic field on the electric arc.

The magnetic blow-out principle is illustrated in FIG. 4 which represents a transverse sectional view of the extinguishing chamber 100, showing the electric arc E in which a current I circulates, the magnetic field generated by the field source 2, represented by the vector B, and the electromagnetic force generated by the magnetic field B on the current I represented by the vector F. The region marked with dashed lines in FIG. 4 represents the breaking region Z, delimited by the internal insulating envelope 4, in which the electric arc E is generated, covering the region of appearance Za and the two regions of extinguishing Ze. It is known that the presence of a magnetic field B and of a current I generates an electromagnetic force F, referred to as Laplace force, which is exerted on the electric arc E created upon opening of the breaking pole PC and which extends in a direction substantially perpendicular to the breaking plane P. In the present case, the electric arc E is moved and stretched in one of the regions of extinguishing Ze of the extinguishing chamber 100, in the direction of one of the lateral faces 33 of the carcass 3 in contact with which the electric arc rapidly cools and is extinguished. Due to the small length of the air gap D2 and due to the geometry of the extinguishing chamber 100, the breaking region Z is narrow, flattened and elongated transversely, which has the effect of forcing the electric arc E during its movement to flatten, which tends to further cool it. In fact, in flattening, the electric arc E offers a larger surface of exchange (oval form of the arc) with the insulating wall 4 which is very close.

It should be noted that the symmetry of the extinguishing chamber 100 with respect to the breaking plane P induces performances that do not vary depending on the direction of the current I and thus depending on the blow-out direction of the electric arc E, irrespectively of whether it is toward the right or toward the left in FIG. 4. As explained above, this symmetry along the breaking plane P, coinciding with the median plane A, can accept a certain tolerance, thus a certain asymmetry, without detrimental effect on the working or on the efficiency of the magnetic chamber 100, according to the embodiment example illustrated in FIG. 21.

Figure 5:
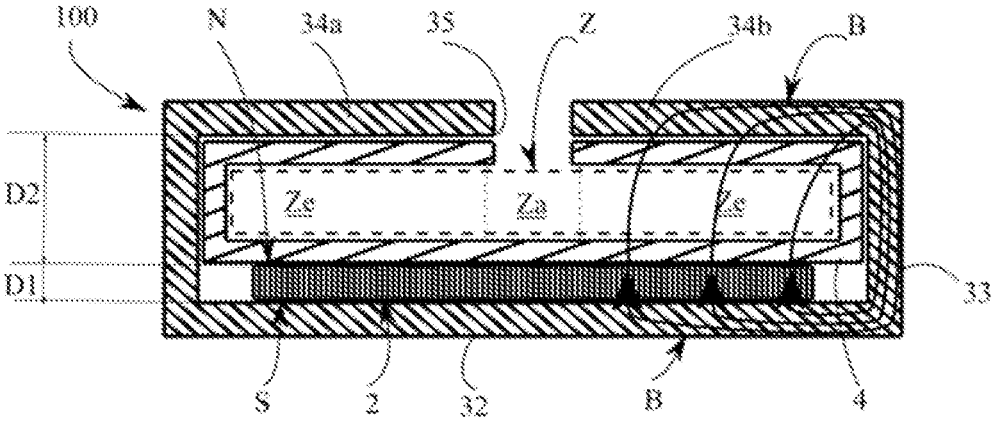
FIG. 5 is a view similar to FIG. 4, representing the channeling of the magnetic field in said extinguishing chamber.

Moreover, the effect of channeling the magnetic field B obtained by the presence of a magnetic carcass 3 is represented only in the right portion of FIG. 5 by the magnetic field lines B which leave the North pole N of the field source 2, pass through the shortest possible portion in the air because of the small length of the air gap D2, and are then concentrated in the carcass 3 via the shortest route in order to close in a loop back to the South pole S of the field source 2. The combination of the carcass 3 making it possible to channel the magnetic flow and of the narrowest possible air gap D2 makes it possible to concentrate and to maximize the magnetic field B which passes through the breaking region Z in order to optimize the management of the electric arc E as soon as it arises in the region of appearance Za until it disappears in the region(s) of extinguishing Ze in the direction of the lateral faces 33 of the carcass 3.

Figure 6:
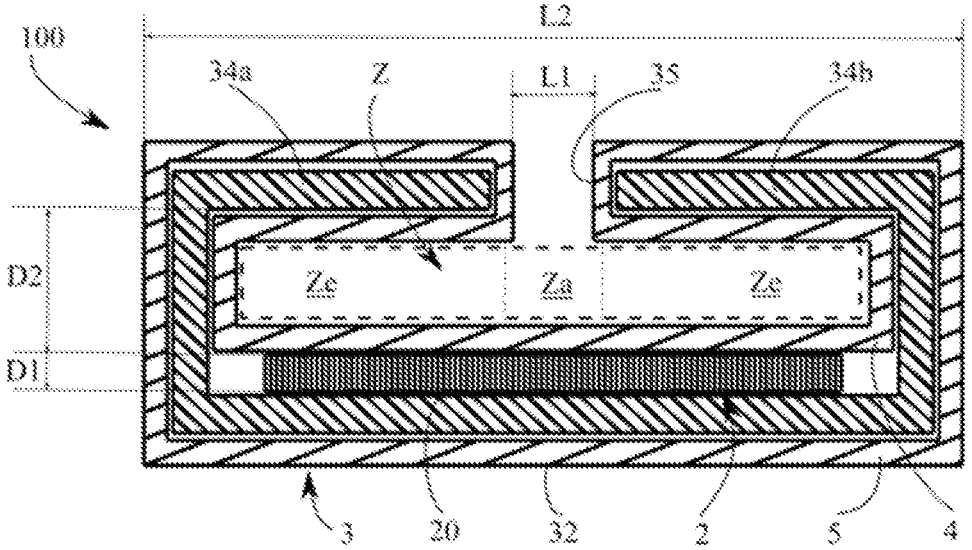
FIG. 6 is a transverse sectional view of the extinguishing chamber of FIGS. 1 and 2, which is externally insulated.

FIG. 6 illustrates, in transverse cross section, a variant of the extinguishing chamber 100, supplemented by an external insulating envelope 5 arranged to electrically insulate the carcass 3 with respect to the outside environment. Just like the internal insulating envelope 4, the external insulating envelope 5 can be made of a molded or injected electrically insulating material, and even a gas producing material, such as, for example, plastic, composite or ceramic materials. If it is material which can be molded, the material can be overmolded around the entire carcass 3, simultaneously forming the internal insulating envelope 4 and the external insulating envelope 5.

Figure 7:
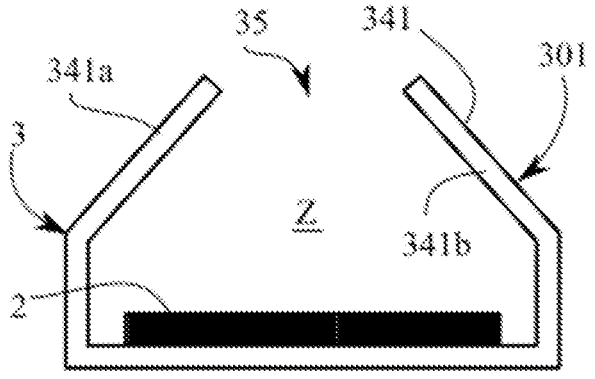
FIG. 7 is a schematic top view of an extinguishing chamber provided with a magnetic carcass according to a first variant.
Figure 8:
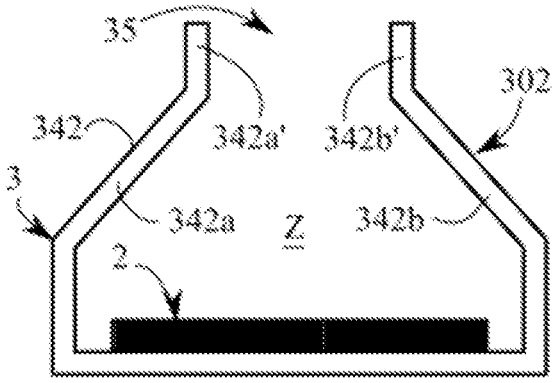
FIG. 8 is a view similar to FIG. 7, showing a magnetic carcass according to a second variant.
Figure 9:
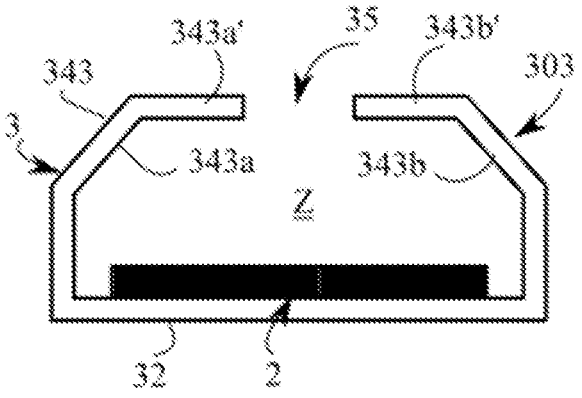
FIG. 9 is a view similar to FIG. 7, showing a magnetic carcass according to a third variant.
Figure 10:
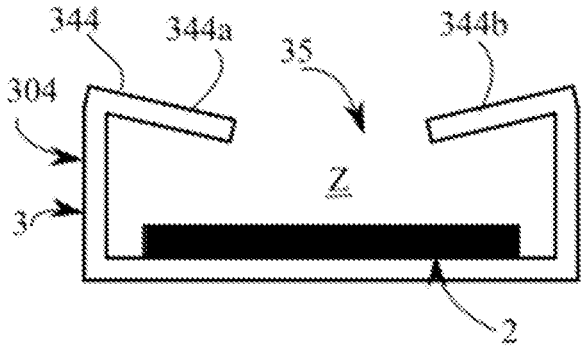
FIG. 10 is a view similar to FIG. 7, showing a magnetic carcass according to a fourth variant.
Figure 11:
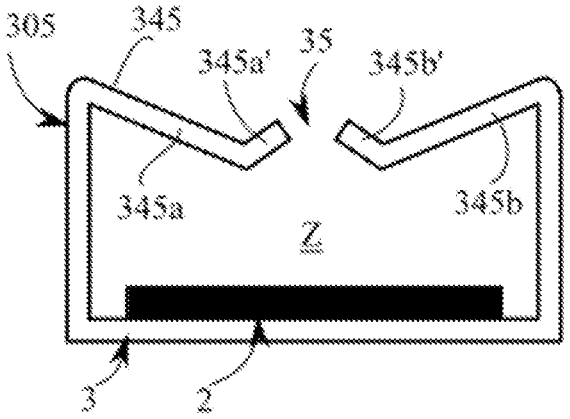
FIG. 11 is a view similar to FIG. 7, showing a magnetic carcass according to a fifth variant.
Figure 12:
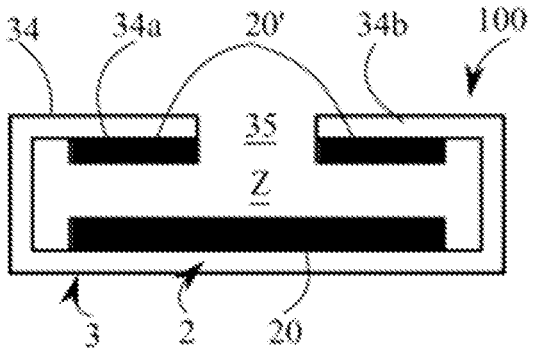
FIG. 12 is a view similar to FIG. 7, showing a magnetic carcass according to a sixth variant.

The channeling principle described in reference to FIGS. 1 to 6 is not limited only to the geometry of the carcass 3 described above. FIGS. 7 to 12 make it possible to illustrate other geometries using the same physical principle. The extinguishing chamber 100 is represented only by its carcass 3 and its field source 2 and it includes six embodiment variants. In FIG. 7, the peripheral wall 301 of the carcass 3 is more open than the preceding peripheral wall 30 and comprises a front face 341 comprising two flaps 341*a* and 341*b* oriented toward the outside in order to increase the volume of the breaking region Z. Thus, this volume can contain more voluminous plasmas, notably in the case of strong currents I, and/or a more voluminous breaking region Z adapted to the space requirement of the breaking pole PC. In FIG. 8, the peripheral wall 302 of the carcass 3 comprises a front face 342 comprising two flaps 342*a* and 342*b* oriented toward the outside, as in the preceding example, but the ends 342*a*' and 342*b*' of which are curved toward the outside and face one another on both sides of the window 35 in order to channel the magnetic flux at the inlet of the breaking region Z. In FIG. 9, the peripheral wall 303 of the carcass 3 comprises a front face 343 comprising two flaps 343*a* and 343*b* oriented toward the outside, but the ends 343*a*' and 343*b*' of which are curved parallel to the rear face 32, in order to channel the magnetic flux at the inlet of the breaking zone Z and increase the magnetic field in the regions of extinguishing Ze of the extinguishing chamber. In FIG. 10, the peripheral wall 304 of the carcass 3 comprises a front face 344 comprising two flaps 344*a* and 344*b* oriented toward the inside, in order to generate more magnetic field in the center in the region of appearance Za than at the ends in the regions of extinguishing Ze of the breaking region Z. In FIG. 11, the peripheral wall 305 of the carcass 3 comprises a front face 345 comprising two flaps 345*a* and 345*b* oriented toward the inside, as in the preceding example, but the ends 345*a*' and 345*b*' of which are curved toward the outside, in order to channel the magnetic flux at the inlet and generate more magnetic field in the region of appearance Za than at the ends in the regions of extinguishing Ze of the breaking region Z. Moreover, it is possible to add additional magnets in the extinguishing chamber 100 such as permanent magnets 20' on the back of the flaps 34*a*, 34*b* of the front face 34, opposite the main permanent magnet 20, in order to further maximize the magnetic field in the regions of extinguishing Ze of the breaking region Z.

Figure 13:
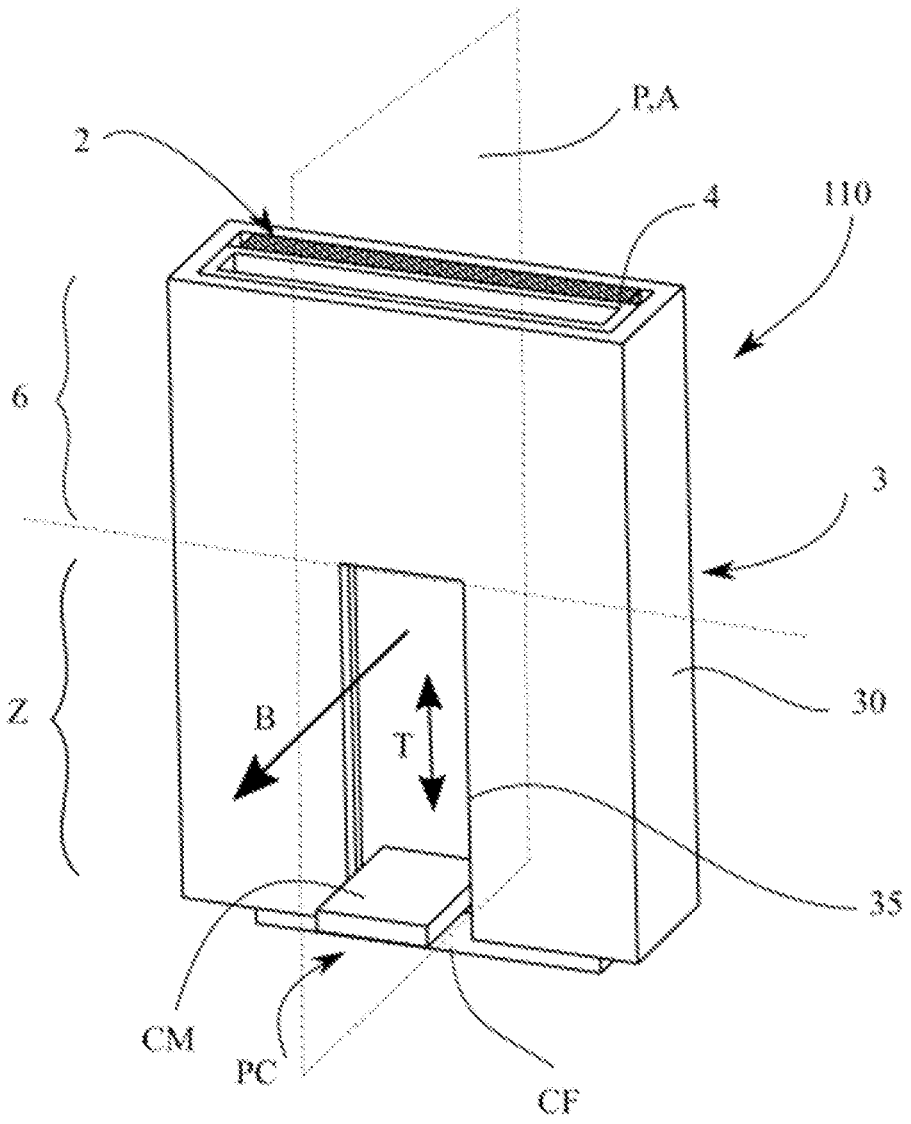
FIG. 13 is a perspective view of an extinguishing chamber according to a second embodiment of the invention, combined with a breaking unit of pressure type in closed position.
Figure 14:
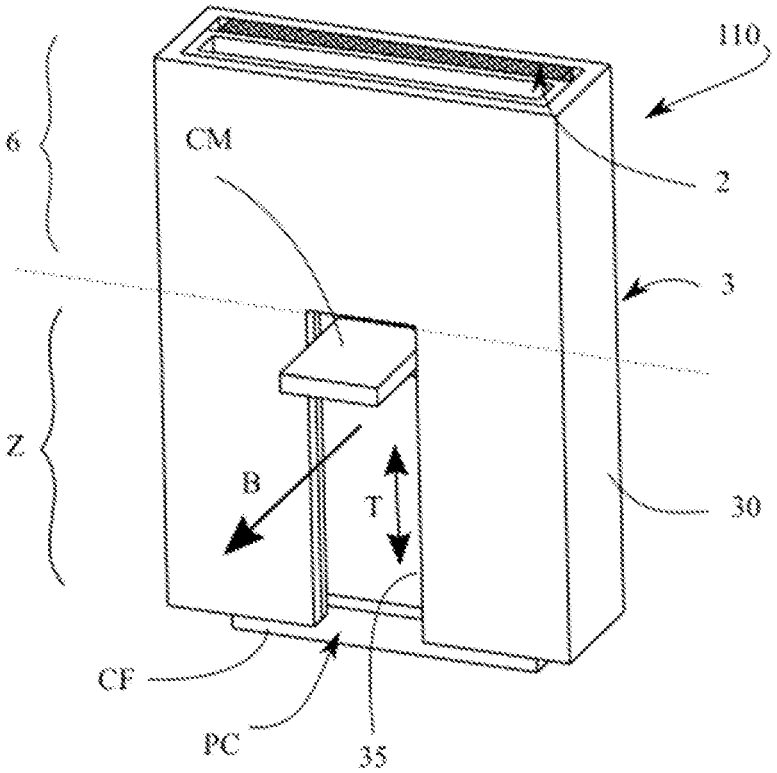
FIG. 14 is a view similar to FIG. 13, showing the breaking unit in the open position.
Figure 15:
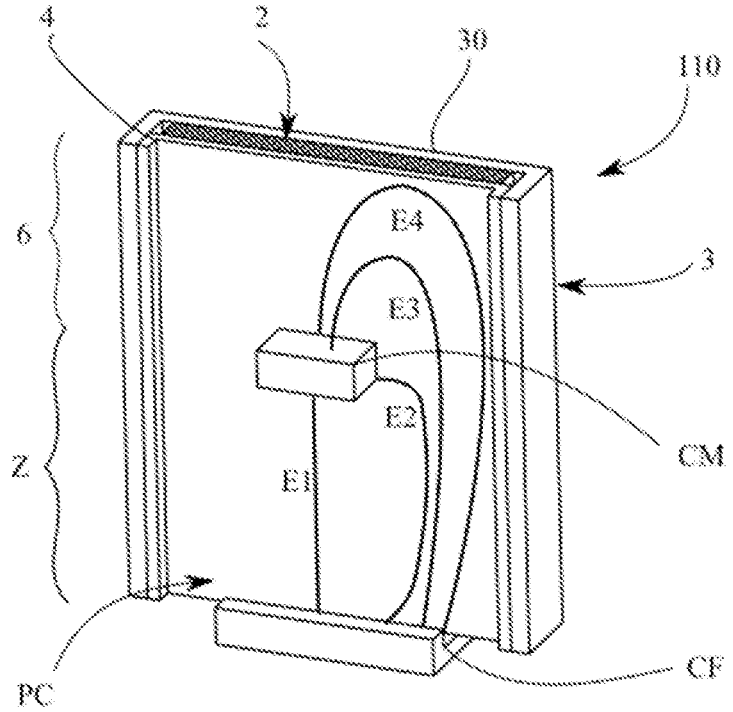
FIG. 15 is a sectional view of the extinguishing chamber of FIG. 14, showing the stretching of the electric arc by an electromagnetic force.

FIGS. 13 to 15 illustrate a second embodiment of an extinguishing chamber 110 according to the invention, which is distinguished from that represented in FIGS. 1 to 6 by a longitudinal dimension much greater than the longitudinal dimension of the breaking pole PC in order to create in the breaking region Z an additional region of extinguishing Ze in the form of a blow-out chimney 6. For this purpose, the carcass 3 comprises a peripheral wall 30, the lower portion of which is open and the upper portion of which is closed. The open lower portion comprises the window 35 for the passage of the movable contact CM which extends in the breaking plane P. The closed upper portion delimits the blow-out chimney 6 promoting the stretching and the extinguishing of the electrical arc E upward. The extinguishing chamber 110 is illustrated in the closed position in FIG. 13 and then in the open position in FIG. 14. FIG. 15 which is a longitudinal sectional view of the extinguishing chamber 110, makes it possible to visualize the different successive positions of the electric arc E (E1=>E2=>E3=>E4) induced by the magnetic blow-out. It is clearly apparent that the blow-out chimney 6 makes it possible to increase the elongation of the electric arc upward, in the rear portion of the movable contact CM. In this embodiment, the fixed contact CF is broadened in order to allow a guiding of the foot of the electric arc E toward the end of the extinguishing chamber 110, in one of the regions of extinguishing Ze, in order to spare the contact pad of the fixed contact CF from deterioration by the electric arc E. As in the case of the extinguishing chamber 100 of FIGS. 1 to 6, the peripheral wall 30 of this extinguishing chamber 110 can be closed at one of its ends or at both of its ends by a transverse wall (not represented) in order to further confine the electric arc E.

Figure 16:
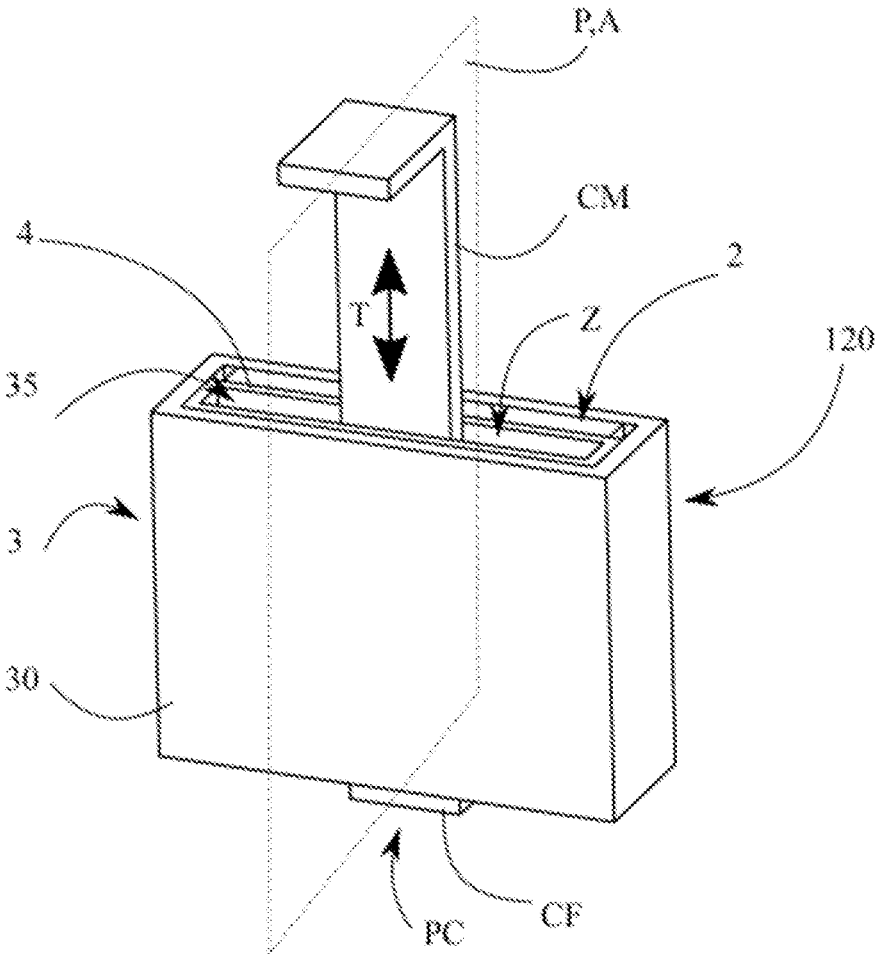
FIG. 16 is a perspective view of an extinguishing chamber according to a third embodiment of the invention, combined with a breaking unit of pressure type in the open position.

FIG. 16 illustrates a third embodiment of an extinguishing chamber 120 according to the invention, which is distinguished from that represented in FIGS. 1 to 6 by a carcass 3 consisting of a closed peripheral wall 30 the transverse ends of which are open, each comprising a window 35 for the passage of the movable contact CM. Thus, the movable contact CM enters completely into the extinguishing chamber 120 by one of its transverse ends, which makes it possible to provide a completely magnetically closed extinguishing chamber 120 in order to further maximize the magnetic field B and obtain a maximum efficiency of the magnetic blow-out in the breaking region Z.

In FIG. 17, the permanent magnet 20 of the field source 2 is replaced by a coil 21 supplied with current for generating a magnetic field B in the breaking region Z. Naturally, the field source 2 can comprise more than one coil 21 and all the variants and versions described or suggested in connection with the preceding solution provided with one or more permanent magnets can be transposed to this embodiment.

FIG. 18 illustrates a transverse cross section of an electrical breaking device 200, showing the placement of two extinguishing chambers 110 according to FIGS. 13 and 14 in a double breaking pole PC, that is to say comprising two fixed contacts CF and two movable contacts CM aligned in the breaking plane P. Naturally, the breaking device 200 represented is simplified to the maximum because it is not part of the invention as such. It can comprise one or more breaking poles PC assembled side by side in one single casing 7 or in juxtaposed individual casings, the electrical contacts of which work in a breaking plane P. In this example, the contacts are of pressure type, the fixed contacts CF of which are extended by a connection terminal 8 and the movable contacts CM of which are borne by a movable assembly 9 controlled in translation T in the breaking plane P by an actuator (not represented).

Figure 19:
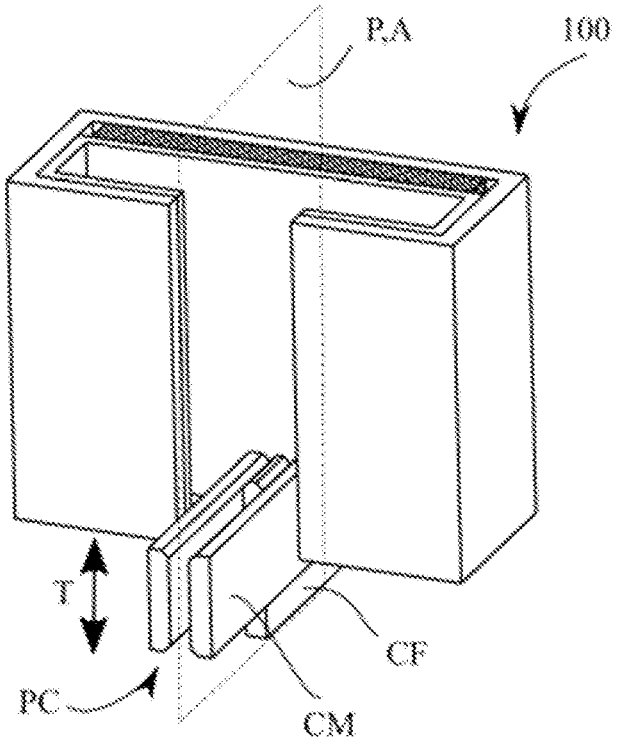
FIG. 19 is a perspective view of an extinguishing chamber according to a fifth embodiment of the invention, combined with a sliding breaking unit of blade type in closed position.
Figure 20:
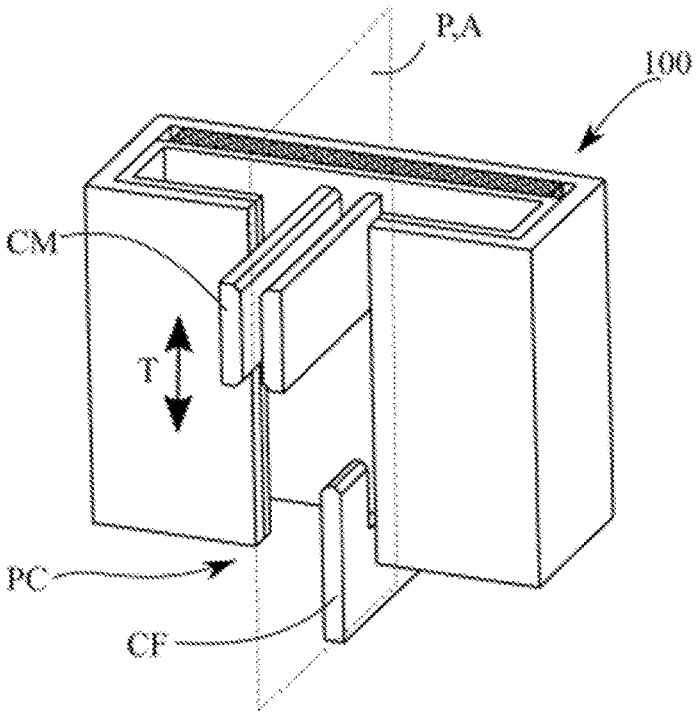
FIG. 20 is a view similar to FIG. 19, showing the breaking unit in the open position.
Figure 21:
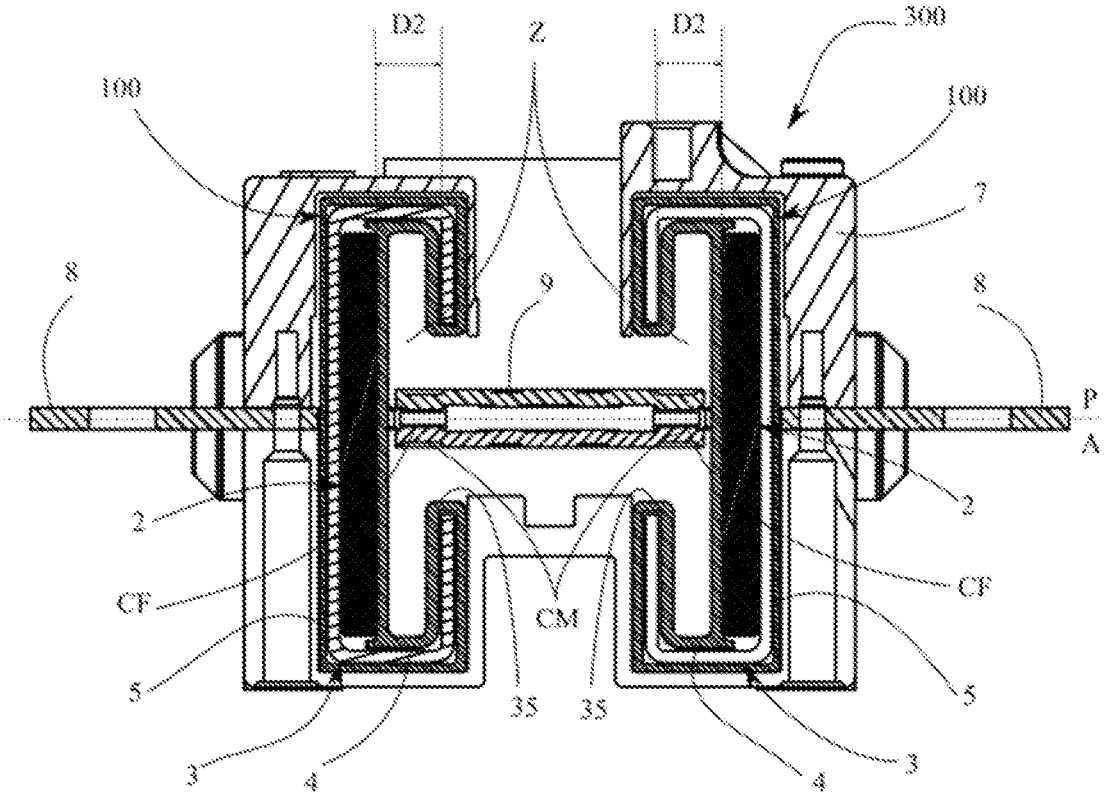
FIG. 21 is a longitudinal sectional view of an electrical breaking device equipped with two extinguishing chambers according to FIGS. 19 and 20.

FIGS. 19 and 20 illustrate the extinguishing chamber 100 of FIGS. 1 to 6 in a version with a breaking pole PC with sliding contacts. The fixed contact CF consists of a blade, also referred to as knife, extending in the breaking plane P, and the movable contact CM consists of a double blade, generally secured by a return unit (not represented) and arranged to fit by sliding on the blade of the fixed contact CF.

FIG. 21 illustrates, in transverse cross section, an electrical breaking device 300, showing the placement of two extinguishing chambers 100 according to FIGS. 6, 19 and 20 in a double breaking pole PC, that is to say comprising two fixed contacts CF and two movable contacts CM aligned in the breaking plane P. As in the example illustrated in FIG. 18, the breaking device 300 represented is simplified to the maximum since it is not part of the invention as such. It can comprise one or more breaking poles PC assembled side by side in single casing 7 or in juxtaposed individual casings the electrical contacts of which work in a breaking plane P. In this example, the contacts are sliding contacts, the fixed contacts CF of which are extended by a connection terminal 8 and the movable contacts CM of which are borne by a movable assembly 9 controlled in translation T in the breaking plane P by an actuator (not represented).

FIGS. 18 and 21 very clearly show the advantage of the extinguishing chamber 100, 110, 120, 130 according to the invention and its ease of integration in any breaking device 200, 300 as close as possible to the fixed contacts CF, since it is positioned at least partially around them, thanks to its flat geometry and its limited volume.

The extinguishing chamber 140 illustrated in FIGS. 22 to 28 has a form similar to the extinguishing chamber 110 illustrated in FIGS. 13 to 15, that is to say a longitudinal dimension much greater than the longitudinal dimension of the breaking pole PC in order to create, in the breaking region Z, an additional region of extinguishing Ze in the form of a blow-out chimney 6. The extinguishing chamber 140 is distinguished from the preceding extinguishing chambers 100, 110, 120, 130 by a magnetic carcass 40, no longer consisting of a solid part but consisting of a stack of splitting sheets 41, also referred to as deionization sheets. Thus, this extinguishing chamber 140 has the advantage of combining multiple technical effects: the channeling of the magnetic field B produced by the field source 2, the greatest possible elongation of the electric arc E and additionally the splitting of the electric arc E into multiple small arcs in order to multiply the arc voltage due to the anode/cathode phenomenon, allowing a more rapid breaking of the current.

The splitting sheets 41 each extend in a plane perpendicular to the breaking plane P, have a small thickness with respect to the two other dimensions, and a cross section equal to the cross section of the carcass 40. In the example represented, this cross section has a general form of a rectangular frame. The carcass 40 consists of two series of splitting sheets: a first series of splitting sheets 41*a*, 41'*a* situated in the open lower portion of the carcass 40, forming a peripheral wall 30 open at the level of the window 35, and a second series of splitting sheets 41*b*, 41'*b* in the closed upper portion of the carcass 40, forming a closed peripheral wall 30. The distribution of the splitting sheets can be ⅔ for the open sheets and ⅓ for the closed sheets, without this example being limiting. The reference numeral 41 used in the description and the claims makes it possible to identify the splitting sheets regardless of their form and their placement in the carcass 40.

The splitting sheets 41 are preferably made of a ferromagnetic or magnetic material or of any other equivalent material with high magnetic permeability allowing the carcass 40 to perform its function of channeling and amplifying the magnetic field B in the breaking region Z as in the carcass 3 of the extinguishing chambers 100, 110, 120, 130 described above. The splitting sheets 41 are stacked on top of one another with a regular or irregular defined spacing. The direction of the stacking is parallel to the median plane A of the extinguishing chamber 140. For this purpose, the carcass 40 comprises two lateral flanges 42 for holding the splitting sheets 41 together and define said spacing. The flanges 42 extend parallel to the median plan A and comprise orifices 43 for receiving projecting pins 44 provided on the lateral sides of the sheets. Naturally, any other attachment means or mounting type can be suitable.

The field source 2 comprises a permanent magnet 20 having thickness D1, which is stood up against the carcass 40 which closes in front thereof so as to create the narrowest possible air gap D2 while encompassing its entire breaking region Z. The magnet 20 has a parallelepiped form adapted to the form of the extinguishing chamber 140. It has a large surface, since it substantially covers the entire surface of the extinguishing chamber 140, making it possible to elongate the electric arc E to the maximum. This magnet 20 can be of ferrite type in order to reduce the costs of the extinguishing chamber 140, without this example of material being limiting.

Figure 25:
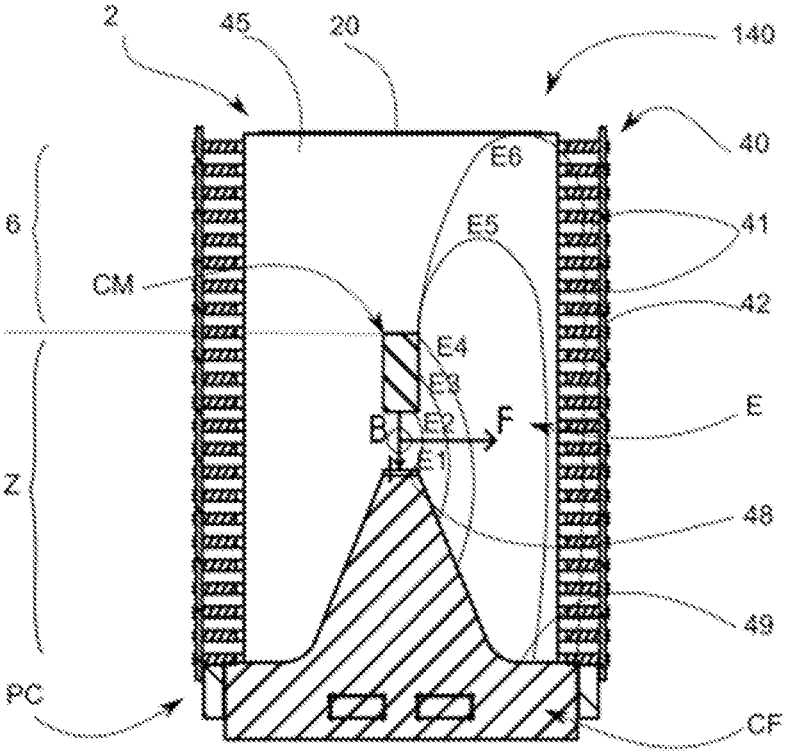
FIG. 25 is a longitudinal sectional view of the extinguishing chamber of FIG. 24 along section plane C, showing the magnetic blow-out of the electric arc.

The magnet 20 is insulated from the regions of appearance Za and of extinguishing Ze of the electric arc by means of an insulating casing 45 in which it is accommodated in its entirety. The electric arc E subjected to the magnetic field B will thus be blown laterally into the sides of the extinguishing chamber 140 in order to enable its elongation. The carcass 40 is partially insulated from the regions of appearance Za and of extinguishing Ze of the electric arc by means of an insulating wall 46 which does not cover the ends of the regions of extinguishing Ze, in order to allow the electric arc E to be split in the stack of splitting sheets 41. The insulating wall 46 is positioned at the inlet of the breaking region Z, on both sides of the window 35, opposite the insulating casing 45. This insulating wall 46 can extend over the periphery of the window 35 in order to protect the edges of the splitting sheets 41*a*, 41'*a*. In the example represented, the insulating casing 45 and the insulating wall 46 are assembled by fitting tabs 47 which form spacers ensuring the air gap D2 and the thickness of the breaking region Z. This breaking region Z thus extends laterally up to the non-insulated splitting sheets 41, allowing the splitting of the electric arc E, as represented in FIG. 25. The insulating casing 45 and the insulating wall 46 are similar to the internal insulating envelope 4 provided in the preceding extinguishing chambers 100, 110, 120, 130, without however insulating the ends of the regions of extinguishing Ze, in order to allow the electric arc to be split in the splitting sheets 41. Moreover, the extinguishing chamber 140 can be protected on the outside by an external insulating envelope 5, as described above.

Figure 22:
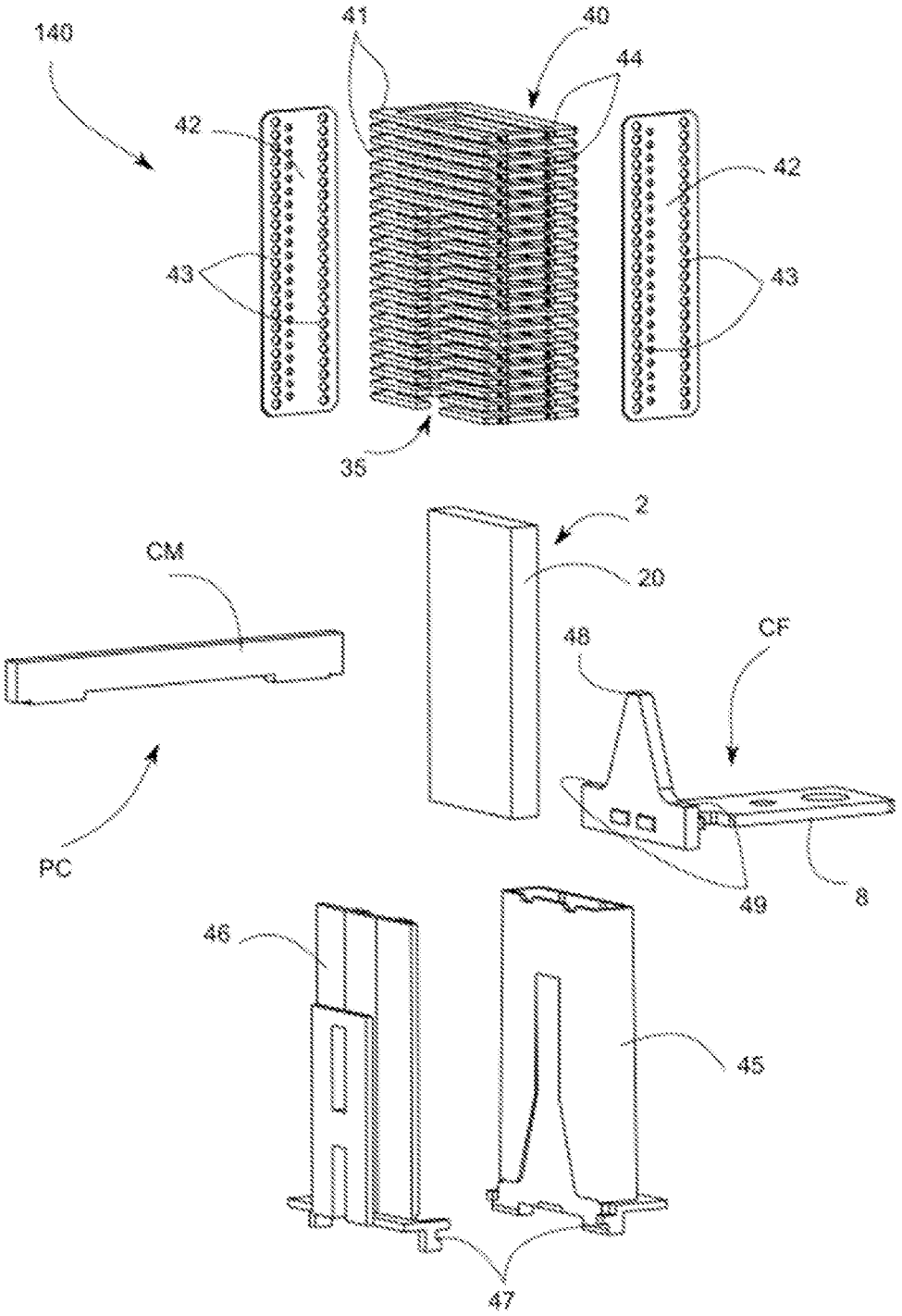
FIG. 22 is an exploded view of an embodiment variant of the extinguishing chamber according to the invention, in which the magnetic carcass consists of splitting sheets.
Figure 23:
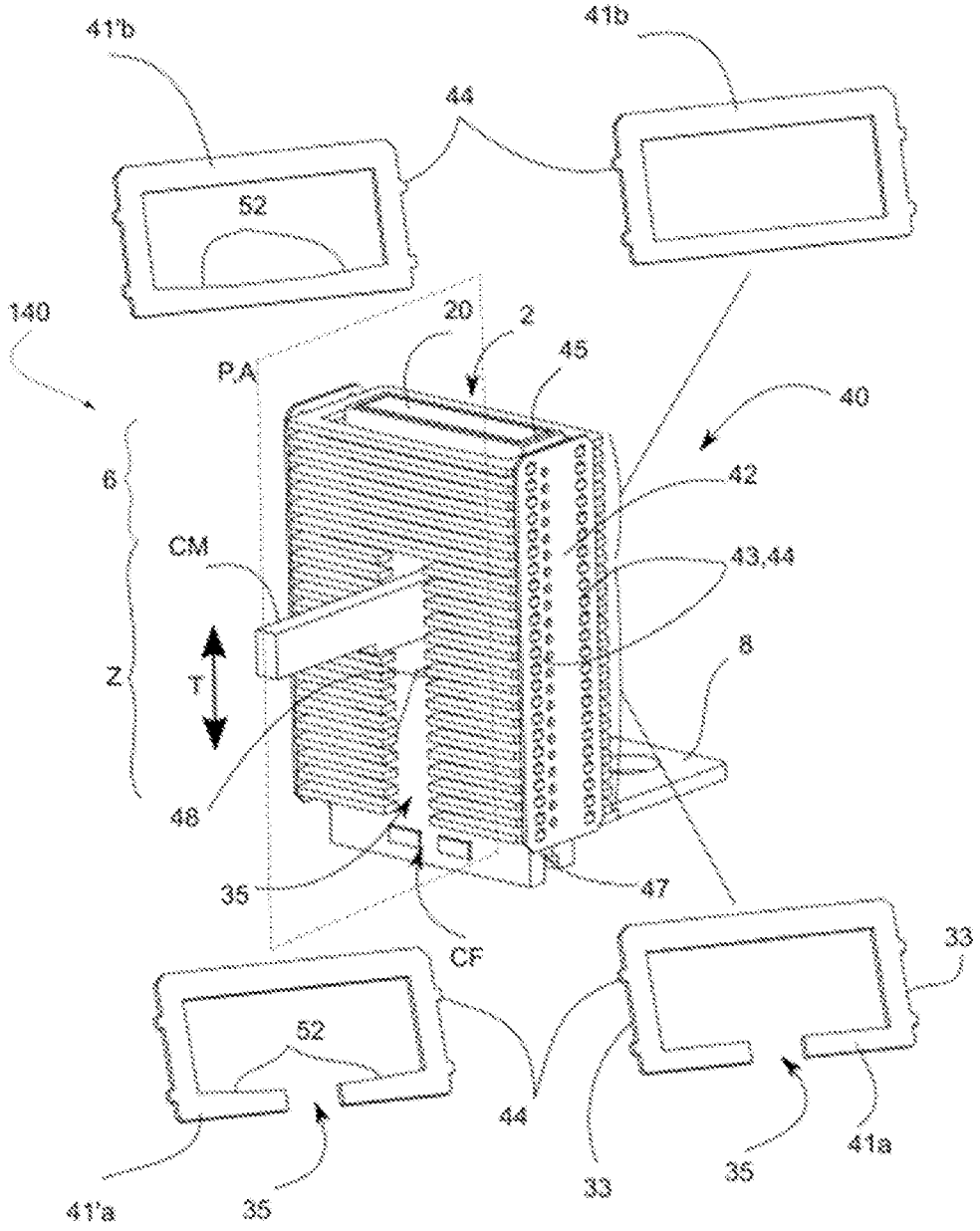
FIG. 23 is an assembled view of the extinguishing chamber of FIG. 22, showing different splitting sheets constituting the carcass.

In the example represented, the breaking pole PC is a double breaking pole and comprises two fixed contacts CF cooperating with a movable contact CM of pressure type (FIGS. 22 and 27). The fixed contacts CF and the movable contact CM commonly comprise contact pads (not represented) made of conductive materials with high thermal resistance, between which the current forms. The movable contact CM is moved by translation along the double arrow T in a breaking plane P which is vertical in the figures, by means of a movable assembly (not represented). In the example represented more particularly in FIG. 22, the fixed contact CF has the form of a bracket having an inner branch, which is vertical in the figures, extending inside of the extinguishing chamber 140, and an outer branch, which is horizontal in the figures, forming a connection terminal 8 extending outside of the extinguishing chamber 140. The inner branch of the fixed contact CF extends in the direction of the blow-out chimney 6 and its summit 48 bearing a contact pad (not represented) stops substantially in a central portion of the breaking region Z, thus moving the contact region, and consequently the region of appearance Za of the electric arc, from an end to a central portion of the extinguishing chamber 140. Moreover, the inner branch of the fixed contact CF comprises a broadened base delimiting two heels 49 oriented in the direction of the carcass 40 and in electrical contact with the first splitting sheet 41 of the carcass 40. This electrical contact can be direct, as in the example represented in FIG. 25, or via an electrical conductor (not represented). The inner branch of the fixed contact CF can have a substantially triangular form, as in the example represented, a form of a bar or any geometric or nongeometric form. The particular geometry of the fixed contact CF allows a large gain in terms of splitting and elongation of the electric arc E as explained in reference to FIG. 25. However, this solution generates a great length of the extinguishing chamber 140, resulting in a large and expensive magnet 20. Depending on the desired performances, a single fixed contact CF which is placed at an end of the extinguishing chamber 140, such as those described in reference to the extinguishing chambers 100, 110, 120, 130 described above, can naturally be suitable.

Figure 24:
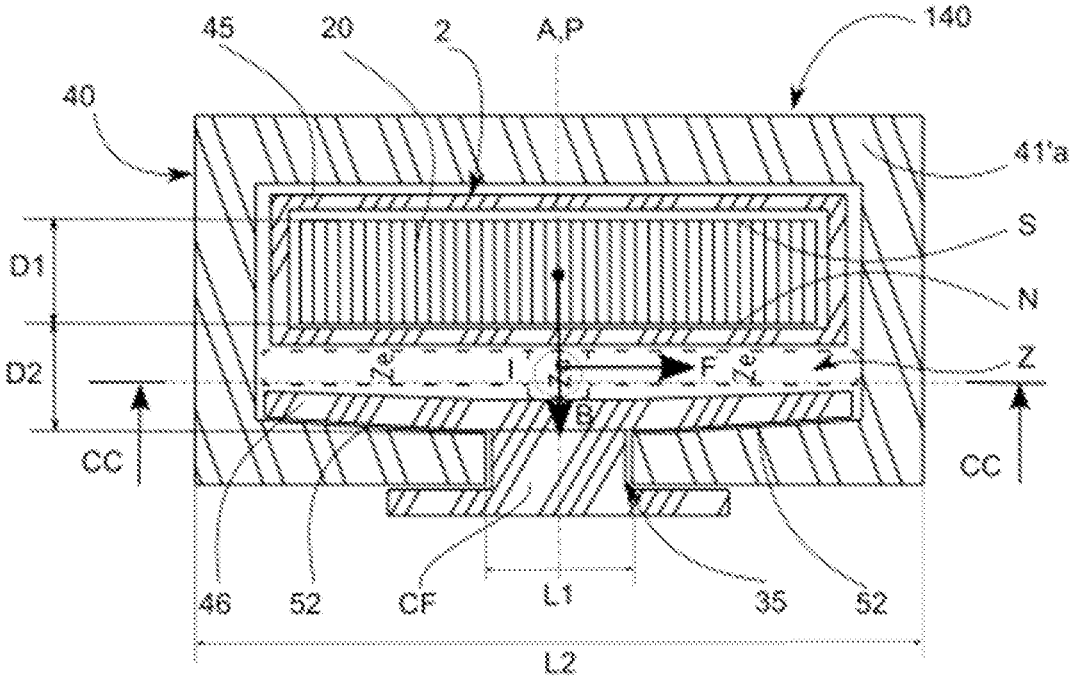
FIG. 24 is a transverse sectional view of the extinguishing chamber of FIG. 23, detailing the breaking region.

FIG. 24 is a transverse cross section of the extinguishing chamber 140, which shows a breaking region Z in which the magnetic blow-out occurs, the principle of which is explained in reference to FIG. 4. In this example, the breaking region Z is quite flattened, and the magnetic reluctance is reduced to its maximum extent, thanks to the fact that the thickness of the breaking region Z narrows in the regions of extinguishing Ze in the direction of the splitting sheets 41. This narrowing makes it possible to physically bring the electric arc E closer to the magnet 20, by reducing the space available for its deployment in the air gap D2, and thus to bring it as close as possible to the magnetic field B as it advances toward the splitting sheets 41. For this purpose, the carcass 40 consists of splitting sheets 41'*a* and 41'*b*, illustrated in FIG. 23, comprising a ramp 52 on the rear of the front face 34, which increases in size in the direction of the lateral faces 33.

FIG. 25 which is a longitudinal cross section of the extinguishing chamber 140 shows the advantage of this embodiment variant of the invention with regard to the management of the electric arc E. It illustrates the different successive positions of the electric arc E (E1=>E2=>E3=>E4=>E5=>E6) induced by the combined effect of the magnetic blow-out of the magnet 20 and of the splitting of the electric arc E in the carcass 40, from its appearance in the contact region of the fixed contact CF and the movable contact CM, substantially in the center of the breaking region Z. Due to the central position of the region of appearance Za of the electric arc, this electric arc E is completely free to be stretched and elongated over the entire height of the extinguishing chamber 140 and over the entire width of the corresponding region of extinguishing Ze and thus to reach a large number of splitting sheets 41. As illustrated, the electric arc E1 rapidly leaves the contact region of the fixed contact CF and the movable contact CM, moving toward the right in the figure, in the direction of the splitting sheets 41. Simultaneously, it moves toward the rear of the movable contact CM in order to be elongated upward in the blow-out chimney 6, toward the base of the fixed contact CF in order to be elongated toward the bottom of the breaking region Z, and laterally up to the splitting sheets 41. The heel 49 of the broadened base of the fixed contact CF in electrical contact with the first splitting sheet 41 of the carcass 40 moreover allows a rapid movement of the electrical arc E1 away from the contact region of the fixed contact CF and the movable contact CM, and a guiding of the foot of the electric arc E toward the end of the extinguishing chamber 140, into one of the regions of extinguishing Ze, and up to the splitting sheets 41. The contact geometry of the fixed contact CF thus makes it possible to spare the contact pad from deterioration by the electric arc E and it also allows the electric arc E to reach the splitting sheets 41 in the lower portion of the extinguishing chamber 140. Thus, the whole stack of the splitting sheets 41 participates in the splitting and in the rapid extinguishing of the electric arc E.

As in the case of the extinguishing chambers 100, 110, 130, the peripheral wall 30 of the carcass 40 of this extinguishing chamber 140 can be closed at one of its ends or at both of its ends by a transverse wall (not represented) in order to further confine the electric arc E, if necessary.

Figure 26:
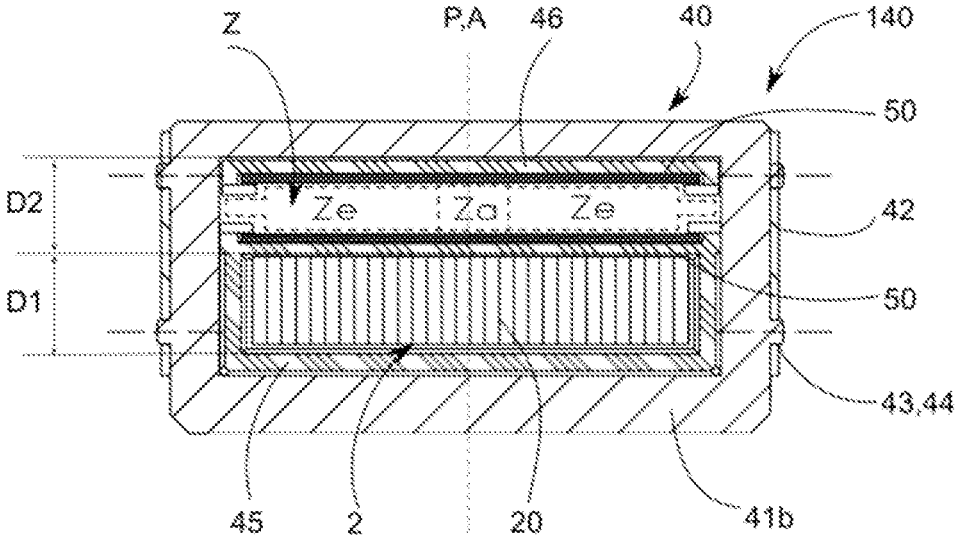
FIG. 26 is a transverse sectional view similar to FIG. 24 of an extinguishing chamber comprising ceramic end plates.
Figure 27:
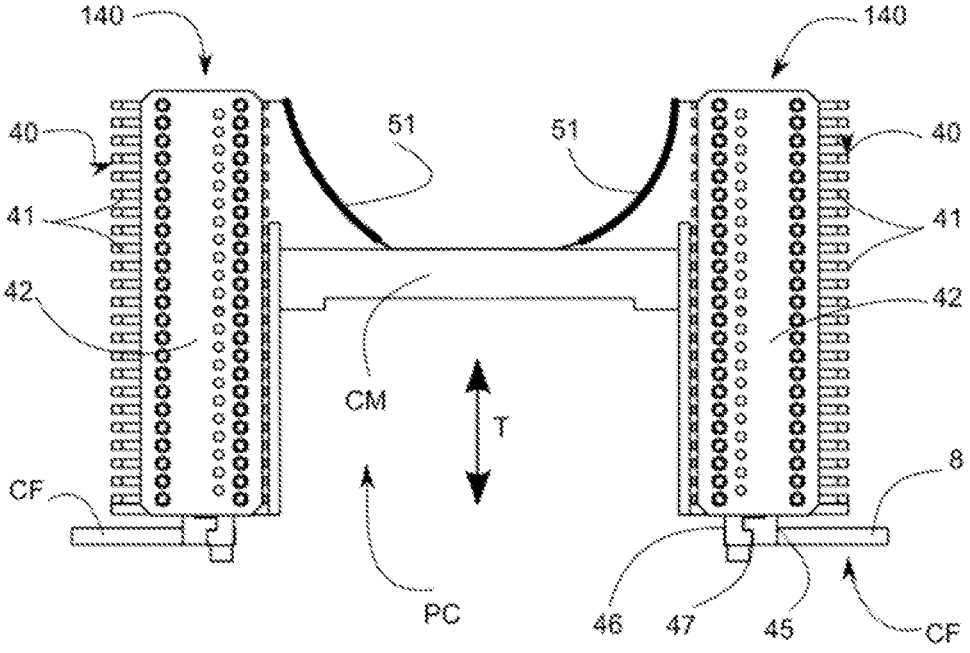
FIG. 27 is a top view of a breaking pole equipped with two extinguishing chambers according to FIG. 23, in which the last splitting sheet is connected to the potential of the movable contact.

FIG. 26 illustrates a variant of the extinguishing chamber 140 comprising additional insulating end plates 50 added in the breaking region Z and superposed on the insulating casing 45 and the insulating wall 46, respectively. These insulating end plates 50 are thus in contact with the region of appearance Za and the region of extinguishing Ze of the electric arc. They can advantageously be made of a ceramic, such as alumina alloy which has advantageous properties for the extinguishing of the electric arc. In addition, its high temperature resistance allows this material to be more resistant to aggressions caused by the electric arc. Thus, the extinguishing chamber 140 will deteriorate less rapidly and will be able to tolerate a larger number of operations. Naturally, any other material having similar properties can be suitable.

FIG. 27 illustrates a complete breaking pole PC comprising two extinguishing chambers 140 arranged around the two fixed contacts CF and through which a movable contact CM circulates, moved in the breaking plane P symbolized by the double arrow T. In this example, the last splitting sheet 41 of each of the extinguishing chambers 140, that is to say the splitting sheet farthest from the fixed contact CF, is connected to the potential of the movable contact CM by an electrical conductor 51, for example, a flexible braid, a spring unit, or the like. The technical effect of this assembly consists in stabilizing the electric arc in the splitting sheets 41, in order to further increase the breaking performances by accelerating the extinguishing of the arc.

Figure 28:
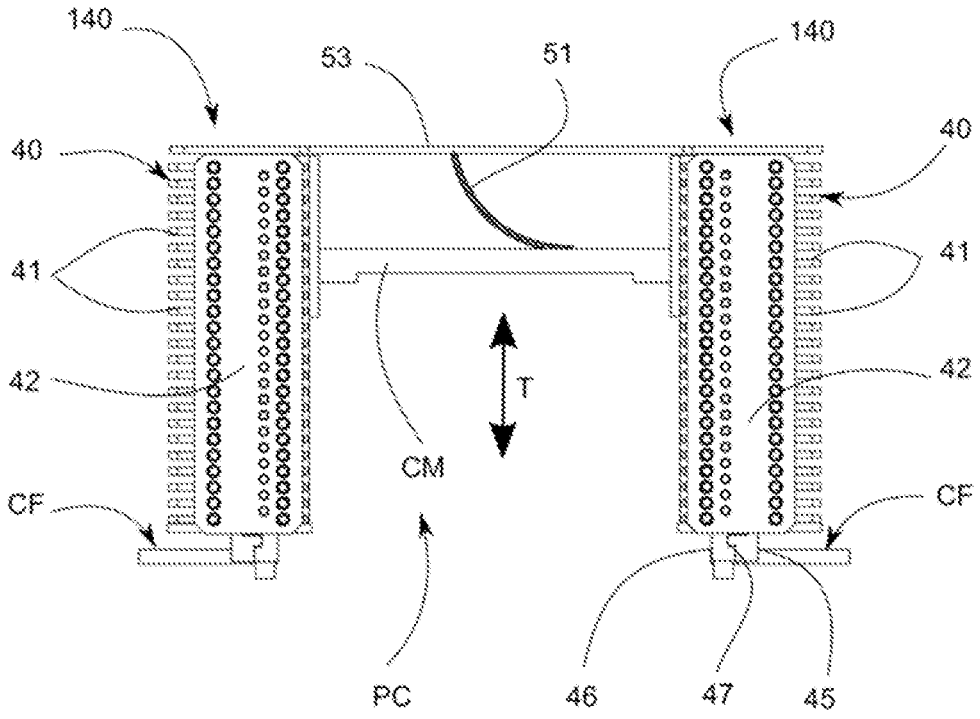
FIG. 28 is a top view of a breaking pole equipped with two extinguishing chambers according to FIG. 23, which are connected to one another by a common upper sheet.

FIG. 28 is a variant of FIG. 27, in which the carcasses 40 of the extinguishing chambers 140 are coupled to one another by a common sheet 53 replacing or in addition to the last splitting sheets 41, that is to say the splitting sheets farthest from the fixed contact CF. In this variant, a single electrical conductor 51 is sufficient to connect the common sheet 53 to the potential of the movable contact CM. It would even be possible to dispense with this electrical conductor 51, making it possible to reduce the cost price and the complexity of this variant, if the two electric arcs E of the two extinguishing chambers Z switch to this common sheet 53. In this case, the electrical potential of the movable contact CM would be moved on this common sheet 53 and the movable contact CM would become "floating." This solution would make it possible, inter alia, to reduce the wear of the contact pads and to stabilize the electric arcs E in the splitting sheets 41.

It is apparent from this description that the invention meets the established objectives, namely an optimized solution for magnetic blow-out of the electric arc, guaranteeing a maximized magnetic excitation in the breaking zone in order to promote the elongation of the electric arc, combined or not with a splitting of the electric arc, for the most rapid possible extinguishing of the electric arc, making it possible to significantly improve the breaking performances for a given grade of magnets. These good results make it possible to select the nature of the magnets, their quantity and their cost depending on the production specifications for each extinguishing chamber, without calling into question the breaking performances.

Moreover, this solution is compatible with and/or adaptable to any type of breaking devices, both for direct current and for alternating current, and it can advantageously replace the conventional extinguishing chambers.

The present invention is naturally not limited to the embodiment examples described, but extends to any amendment and variant obvious to a person skilled in the art, while remaining within the scope of protection defined in the appended claims. It is notably obvious that the embodiment variants described in reference to one of the extinguishing chambers 100, 110, 120, 130, 140 can apply to the other extinguishing chambers.

The invention claimed is:

1. An extinguishing chamber of magnetic blow-out type for an electrical breaking device, said extinguishing chamber comprising a magnetic field source, a magnetic carcass and a breaking region in which an electric arc is liable to form notably when a breaking pole belonging to a breaking device is opened, said field source being arranged to generate a magnetic field configured to move said electric arc in order to stretch it and accelerate its cooling and its extinguishing, and said carcass being arranged to channel said magnetic field, said breaking pole comprising a fixed contact and a movable contact which moves with respect to said fixed contact between a closed position and an open position on a path defining a breaking plane, and said breaking region extending at least in said breaking plane, characterized in that said extinguishing chamber has a mostly symmetrical form with respect to a median plane which coincides with said breaking plane, in that said field source is arranged in the near vicinity of and opposite said breaking region and is oriented to generate magnetic field vectors which are essentially parallel to said breaking plane, in that said carcass surrounds said breaking region and said field source and comprises a window which is open toward the outside in order to allow a passage of said movable contact, and in that said carcass is stood up against said field source and closes in front thereof so as to create an air gap in the magnetic circuit formed by said field source and said carcass and to thus maximize the magnetic field that passes through said breaking region.

2. The extinguishing chamber of magnetic blow-out type according to claim 1, characterized in that said carcass comprises an open peripheral wall delimiting said window which extends parallel to said breaking region.

3. The extinguishing chamber of magnetic blow-out type according to claim 1, characterized in that said carcass comprises a closed peripheral wall and an opening at at least one transverse end of said peripheral wall delimiting said window which extends perpendicular to said breaking region.

4. The extinguishing chamber of magnetic blow-out type according to claim 1, characterized in that said extinguishing chamber extends over a length greater than a length of said breaking region in said breaking plane, and in that said carcass comprises a partially open and partially closed peripheral wall, the open portion delimiting said window which extends parallel to said breaking region, and the closed portion extending said open portion and delimiting a blow-out chimney for the extension of the electric arc.

5. The extinguishing chamber of magnetic blow-out type according to claim 2, characterized in that said carcass further comprises at least one transverse wall closing at least one of the transverse ends of said peripheral wall.

6. The extinguishing chamber of magnetic blow-out type according to claim 2, characterized in that a peripheral wall of said carcass has a transverse section having a form selected from the group consisting of a curved form, a polygonal form, a complex form, and a form combining straight sections and curved sections.

7. The extinguishing chamber of magnetic blow-out type according to claim 6, characterized in that a polygonal form of the peripheral wall of said carcass is selected from the group consisting of a rectangle, an isosceles trapezoid, and a C-shaped form the ends of which form flaps oriented toward the outside or toward the inside of said breaking region, or parallel to said breaking region.

8. The extinguishing chamber of magnetic blow-out type according to claim 1, characterized in that said field source is selected from the group consisting of one or more permanent magnets, and one or more coils, and in that said field source extends over a surface which is substantially equal to the surface of said extinguishing chamber.

9. The extinguishing chamber of magnetic blow-out type according to claim 1, characterized in that said extinguishing chamber comprises an internal insulating envelope extending at least partially around said breaking region in order to electrically insulate said field source and at least partially said carcass.

10. The extinguishing chamber of magnetic blow-out type according to claim 1, characterized in that said extinguishing chamber comprises an external insulating envelope extending around said carcass.

11. The extinguishing chamber of magnetic blow-out type according to claim 1, characterized in that said carcass extends over a transverse dimension, perpendicular to the breaking plane, in order to divide said breaking region into a region of appearance in which said electric arc arises and at least one region of extinguishing in which said electric arc is stretched and extinguished.

12. The extinguishing chamber of magnetic blow-out type according to claim 11, characterized in that said transverse dimension of the extinguishing chamber is at least equal to X times the transverse dimension of said region of appearance, X being between 2 and 10.

13. The extinguishing chamber of magnetic blow-out type according to claim 1, characterized in that the geometry of said extinguishing chamber delimits a narrow and flattened breaking region in order to force the electric arc to flatten when it is moved by said magnetic field, and in that said air gap, created in the magnetic circuit formed by said field source and said carcass, is narrow in order to reduce the magnetic reluctance in the air and maximize the magnetic field that passes through said breaking region.

14. The extinguishing chamber of magnetic blow-out type according to claim 1, characterized in that said carcass consists of a solid ferromagnetic part in order to channel the magnetic field.

15. The extinguishing chamber of magnetic blow-out type according to claim 1, characterized in that said carcass consists of a stack of ferromagnetic splitting sheets, extending in the longitudinal axis of said extinguishing chamber, with a defined spacing, in order to simultaneously channel the magnetic field and split the electric arc.

16. The extinguishing chamber of magnetic blow-out type according to claim 11, characterized in that said carcass comprises a ramp arranged to narrow the thickness of the breaking region in the direction of the end of said at least one region of extinguishing.

17. The extinguishing chamber of magnetic blow-out type according to claim 9, characterized in that said extinguishing chamber further comprises ceramic insulating end plates, at least partially superposed on said internal insulating envelope, on both sides of said breaking region.

18. An electrical breaking device comprising at least one breaking pole which comprises a fixed contact and a movable contact which moves with respect to said fixed contact between a closed position and an open position on a path defining a breaking plane, and comprising at least one extinguishing chamber of magnetic blow-out type, which comprises a magnetic field source, a magnetic carcass and a breaking region in which an electric arc is liable to form notably when said breaking pole is opened, said field source being arranged to generate a magnetic field configured to move said electric arc in order to stretch it and accelerate its cooling and its extinguishing, said carcass being arranged to channel said magnetic field, and said breaking region extending at least in said breaking plane, characterized in that said electrical breaking device comprises an extinguishing chamber according to claim 1, said extinguishing chamber having a substantially symmetrical form with respect to a median plane which coincides with said breaking plane, and in which said field source is arranged in the near vicinity of and opposite said breaking region and is oriented to generate magnetic field vectors which are essentially parallel to said breaking plane, in that said carcass surrounds said breaking region and said field source, and comprises a window which is open toward the outside in order to allow the passage of said movable contact, and in that said carcass is stood up against said field source and closes in front thereof so as to create an air gap in the magnetic circuit formed by said field source and said carcass and to thus maximize the magnetic field that passes through said breaking region.

19. The breaking device according to claim 18, characterized in that said fixed contact is in the form of a bracket, an inner branch of which extends inside said extinguishing chamber in said median plane, and an outer branch extending outside said extinguishing chamber in order to form a connection terminal, and in that said inner branch of said fixed contact comprises a summit positioned in a central portion of said breaking region, placing said region of appearance of the electric arc in a central portion of said extinguishing chamber.

20. The breaking device according to claim 19, characterized in that an inner branch of said fixed contact comprises a broadened base delimiting at least one heel oriented toward an end of said extinguishing chamber in one of the regions of extinguishing of the electric arc.

21. The breaking device according to claim 20, characterized in that a splitting sheet of said extinguishing chamber closest to said fixed contact is connected to the potential of said fixed contact by said at least one heel.

22. The breaking device according to claim 18, characterized in that a splitting sheet of said extinguishing chamber farthest from said fixed contact is connected to the potential of said movable contact by an electrical conductor.

23. The breaking device according to claim 18, comprising two extinguishing chambers per breaking pole, characterized in that the carcasses of said extinguishing chambers are coupled to one another by a common sheet replacing or added to the splitting sheets farthest from said fixed contact, and in that said common sheet is or is not connected to the potential of said movable contact by an electrical conductor.

* * * * *